US012807451B2

(12) United States Patent
Inokuchi

(10) Patent No.: US 12,807,451 B2
(45) Date of Patent: Nov. 24, 2026

(54) PAPER CREASING DEVICE AND PRINTER

(71) Applicants: CITIZEN WATCH CO., LTD., Tokyo (JP); CITIZEN SYSTEMS JAPAN CO., LTD., Tokyo (JP)

(72) Inventor: Yutaka Inokuchi, Nagano (JP)

(73) Assignees: CITIZEN WATCH CO., LTD., Tokyo (JP); CITIZEN SYSTEMS JAPAN CO., LTD., Tokyo (JP)

( * ) Notice: Subject to any disclaimer, the term of this patent is extended or adjusted under 35 U.S.C. 154(b) by 92 days.

(21) Appl. No.: 18/848,812

(22) PCT Filed: Nov. 25, 2022

(86) PCT No.: PCT/JP2022/043570
§ 371 (c)(1),
(2) Date: Sep. 19, 2024

(87) PCT Pub. No.: WO2023/188537
PCT Pub. Date: Oct. 5, 2023

(65) Prior Publication Data

US 2025/0223131 A1 Jul. 10, 2025

(30) Foreign Application Priority Data

Mar. 28, 2022 (JP) ..... 2022-051186

(51) Int. Cl.
*B65H 45/30* (2006.01)

(52) U.S. Cl.
CPC ..... *B65H 45/30* (2013.01)

(58) Field of Classification Search
CPC ..... B65H 45/30; B65H 29/00; B26D 1/185; B26D 3/085; B26D 7/2621; B31B 50/146;

(Continued)

(56) References Cited

U.S. PATENT DOCUMENTS 1,362,330 A * 12/1920 Lange ..... B31B 50/00 229/125.17
6,837,840 B2 * 1/2005 Yonekawa ..... B65H 45/18 493/449

(Continued)

FOREIGN PATENT DOCUMENTS

JP S54128517 U 9/1979
JP 2002011811 A 1/2002

(Continued)

OTHER PUBLICATIONS

International Search Report from corresponding International Application No. PCT/JP2022/043570, mailed on Jan. 17, 2023, 4 pages with translation.

(Continued)

*Primary Examiner* — Michael Collins
(74) *Attorney, Agent, or Firm* — Tucker Ellis LLP

(57) ABSTRACT

A device for creasing a paper includes a receiving member provided with a groove that extends in a fixed direction; a rotary blade that is configured to be movable along the groove; and a moving mechanism for moving the rotary blade along the groove. The rotary blade includes a radial bearing that is formed of a combination of an inner race and an outer race, the radial bearing including a flange portion that is monolithically formed with the outer race. The radial bearing is configured to move by the moving mechanism, while the radial bearing sandwiches the paper between the flange portion and the groove and keeps a condition in which the flange portion is inserted in the groove.

4 Claims, 15 Drawing Sheets

(58) Field of Classification Search
CPC .. B31B 50/256; B31F 1/08; B31F 1/10; B41J 11/0015
See application file for complete search history.

(56) References Cited

U.S. PATENT DOCUMENTS

| | | | | |
|---|---|---|---|---|
| 7,673,863 | B2 * | 3/2010 | Iguchi | B65H 45/18 270/32 |
| 11,492,227 | B1 * | 11/2022 | Sugizaki | B65H 31/34 |
| 2006/0116263 | A1 | 6/2006 | Rathbun et al. | |
| 2009/0293699 | A1 | 12/2009 | Walian | |
| 2011/0221115 | A1 * | 9/2011 | Fukatsu | B65H 45/18 270/32 |
| 2012/0046154 | A1 * | 2/2012 | Takeuchi | B65H 45/18 493/405 |
| 2013/0087965 | A1 * | 4/2013 | Shimizu | B65H 45/18 270/45 |
| 2013/0291703 | A1 | 11/2013 | Walian | |
| 2014/0152752 | A1 | 6/2014 | Hoshino | |
| 2014/0203486 | A1 * | 7/2014 | Sugiyama | B31F 1/00 270/45 |
| 2014/0206518 | A1 * | 7/2014 | Hidaka | B31F 1/0006 493/416 |
| 2015/0065327 | A1 * | 3/2015 | Tsunoda | B65H 45/18 493/454 |
| 2016/0313687 | A1 * | 10/2016 | Osada | B42C 3/00 |
| 2025/0026604 | A1 | 1/2025 | Inokuchi | |

FOREIGN PATENT DOCUMENTS

| | | | |
|---|---|---|---|
| JP | 4541621 | B2 | 9/2010 |
| JP | 2011213467 | A | 10/2011 |
| JP | 2014131829 | A | 7/2014 |
| JP | 2020097082 | A | 6/2020 |

OTHER PUBLICATIONS

Japanese Office Action from corresponding Application No. 2024511206 mailed on May 7, 2025, 6 pages.

Office Action from corresponding Chinese Application No. 202280093917.3 mailed on Sep. 24, 2026, 16 pages with translation.

* cited by examiner

SECT.A-A

PAPER CREASING DEVICE AND PRINTER

CROSS-REFERENCE TO RELATED APPLICATION

The present application is a national entry of International Application No. PCT/JP2022/043570, filed Nov. 25, 2022, and claims priority to Japanese Patent Application No. 2022-051186, filed Mar. 28, 2022, the disclosures of which are incorporated herein by reference in their entireties.

TECHNICAL FIELD

The present application relates to a paper creasing device and a printer.

BACKGROUND ART

As a post- or pre-processing device for printing, creasers are known to crease paper. A creaser is a device that forms a crease(s) on relatively thick paper or paper with high rigidity and stiffness. For example, when multiple sheets of the above-mentioned stiff paper are bound together, even if one tries to open each page by turning over the paper, it is not possible to fully open the same, due to stiffness of the paper, resulting in poor openability.

For example, it is optional to make a photo book by printing a photograph(s), etc. on each resin layer of a printing paper prepared by respectively forming dye-receptive layers (receptive layers) on both of the front and back surfaces of a core paper and then bundling multiple sheets of the printing paper. Even in such photo book, similar to the above-mentioned paper, the poor openability condition could happen.

Thus, if a crease is formed in advance by a creasing device in the vicinity of a bound part of the photo book, when the pages are opened, it becomes possible to fully open the pages by the crease as a fold, thereby improving openability.

There are also cards, such as greeting cards, which are made of thick paper folded in the center. Greeting cards are finished by inwardly folding the side with the printed message. When the recipient opens the greeting card, the message appears from the inside. In such a case, when the center of the paper is creased to make a fold, it is possible to obtain a well-finished card by preventing a problem in which, when the paper is folded, the fold deviates, bends or spreads from the center, due to stiffness of the paper.

A creasing device forms a crease on paper by sandwiching both sides of the paper between a groove extending in a predetermined direction and a blade that is fitted into the groove. Here, there is a rotary creasing device that uses a rotating blade (rotary blade) rotating along the groove (see, for example, JP 2009-286124A).

The rotary creasing device places paper on a receiving member formed with a groove, presses a rotary blade against a part of the paper, which corresponds to the groove, from above the paper, and moves the rotary blade along the groove with its rotation, thereby forming a crease along the groove on the paper.

SUMMARY

In the rotary creasing device, the rotary blade has been made to rotate by using a bearing. The rotary blade is formed by covering an outer circumference of the bearing with a component that serves as a blade. Therefore, the rotary blade has a double structure of the bearing and the component that serves as a blade, thereby causing the rotary blade as a whole to have a larger diameter. This has been causing the rotary creasing device to have a larger size.

The present application was made in view of the above situation, and its object is to provide a paper creasing device and a printer, in which the device can be made more compact by an improvement on the rotary blade.

According to a first aspect of the present application, there is provided a paper creasing device, including a receiving member provided with a groove that extends in a fixed direction; a rotary blade that is configured to be movable along the groove; and a moving mechanism for moving the rotary blade along the groove, wherein the rotary blade includes a radial bearing that is formed of a combination of an inner race and an outer race, the radial bearing including a flange portion that is monolithically formed with the outer race, wherein the radial bearing is configured to move by the moving mechanism, while the radial bearing sandwiches a paper between the flange portion and the groove and keeps a condition in which the flange portion is inserted in the groove.

According to a second aspect of the present application, there is provided a printer including the paper creasing device according to the first aspect of the present application.

DESCRIPTION OF EMBODIMENT

With respect to the use of plural and/or singular terms herein, those having skill in the art can translate from the plural to the singular and/or from the singular to the plural as is appropriate to the context and/or application. The various singular/plural permutations may be expressly set forth herein for sake of clarity.

A paper creasing device according to the present embodiment and an embodiment of a printer including the paper creasing device will be described as follows with reference to the drawings.

FIGS. 1 to 16 are those for describing this embodiment.

First Embodiment

Configuration of this embodiment is described in the following.

Configuration of Printer 200

Figure 1:
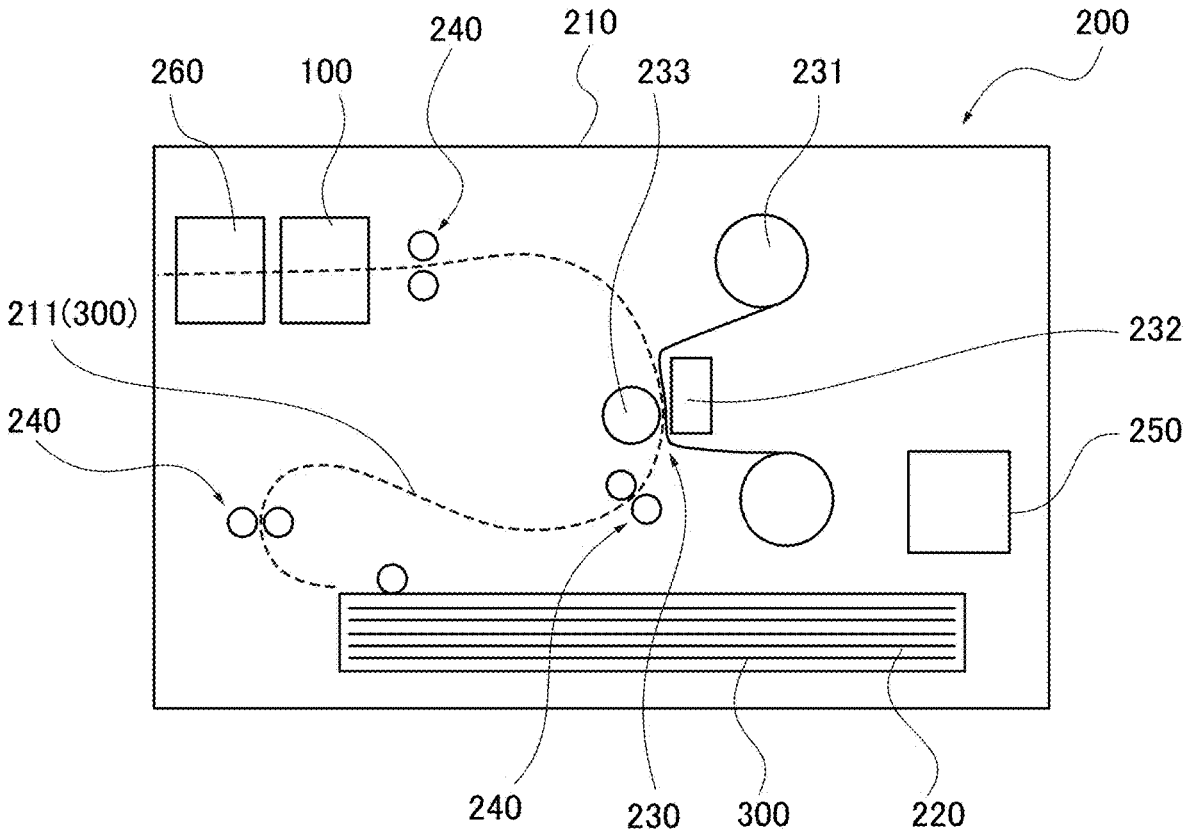
FIG. 1 is a schematic constitutional side view of a photo printer including a paper creasing device in the inside.

FIG. 1 is a configurative view of a printer 200, such as a photo printer. The printer 200 is of a so-called dye-sublimation thermal-transfer type. The printer 200 of a dye-sublimation thermal-transfer type prints by applying heat to an ink ribbon 231 under a condition that the ink ribbon 231 is pressed against a sheet of paper 300 to make a diffusion transfer of a sublimation dye, which has been applied to the ink ribbon, to the paper 300. The printer 200 includes in its inside a device 100 for creasing the paper 300.

The paper 300 is, for example, one made by respectively attaching and applying multiple resin layers (receptive layers) to both of front and back surfaces of a core paper, and has a certain degree of rigidity. The paper 300 is, for example, 200 [μm] thickness. The thickness of the paper 300 is not limited to 200 [μm].

The sublimation dye of the above-mentioned ink ribbon 231 is transferred by diffusion to the top surface resin layer of the paper 300. The printer 200 is a sheet-fed machine that prints on both sides of the paper 300, using sheet paper cut into rectangular sheets one by one as the paper 300.

The printer 200 is an embodiment of the printer according to the present application. The printer 200 includes, inside an outer case 210, a paper storage section 220, a printing section 230 and a cutter 260 in sequence along a conveying path 211 of the paper 300. At various places of the conveying path 211, conveyors 240 are provided.

The creasing device 100 is a device for creasing the paper 300 and may be formed into a module to become an independent configuration. The creasing device 100 is attached to (built into) the printer 200, thereby providing the printer 200 with a creasing function. In the drawing, the creasing device 100 is installed between the printing section 230 and the cutter 260 inside the outer case 210. However, the installation position of the creasing device 100 is not limited to the above.

The printer 200 includes a controller 250 inside the outer case 210. However, configuration of the printer is not limited to the above.

Here, the outer case 210 is formed into a generally rectangular shape in outline. It is preferable to make the outer case 210 as small as possible in terms of vertical, width and depth dimensions. The paper storage section 220 is a space or container (tray) that accommodates the paper 300 to be printed by the printer 200. The paper storage section 220 accommodates multiple sheets of the sheet paper 300 stacked in the thickness direction.

The printing section 230 includes a thermal head 232 and a platen roller 233. The platen roller 233 and the thermal head 232 are positioned opposite each other so as to sandwich the ink ribbon 231 and the paper 300. The platen roller 233 works with the thermal head 232 to press the paper 300 against the ink ribbon 231. The thermal head 232 applies heat to the ink-applied ink ribbon 231 to make a diffusion transfer of a sublimation dye of the ink ribbon 231 to the resin layer of the paper 300 in contact with the ink ribbon 231, thereby making printing.

A number of conveyors 240 are installed at various places along the conveying path 211 of the paper 300 in the outer case 210. For example, the conveyor 240 is installed singly or in plurality between the paper storage section 220 and the printing section 230 to transport the paper 300 stored in the paper storage section 220 to the printing section 230. The conveyor 240 is installed singly or in plurality between the printing section 230 and the creasing device 100 to transport the paper 300, which has been printed at the printing section 230, to the creasing device 100 or the cutter 260. The conveyor 240 is installed inside the cutter 260 for the discharge to the outside of the printer 200, after a portion of the paper 300, which has been creased by the creasing device 100, is cut according to need by the cutter 260 to make a front edge 301 of the paper 300.

The conveyor 240 includes transport rollers and a power transmission mechanism, a sensor, and a motor. The transport rollers and the power transmission mechanism move the paper 300 along the conveying path 211. The sensor is provided on the conveying path 211 to detect the paper 300. The sensor is an optical sensor, such as a photo reflector or photo interrupter, but may also be a mechanical sensor using a contact. The motor provides the conveyance force to the power transmission mechanism.

The controller 250 controls each operation of the printing section 230, the conveyor 240, the cutter 260, and the creasing device 100. The controller 250 controls the operation of the motor to transport the paper 300, for example, based on the result of detection of the paper 300 by the sensor provided in the conveyor 240.

Based on the print data input and stored prior to printing, the controller 250 controls the conveyor 240 and the printing section 230 to print on the paper 300 the content (a visible image such as landscape or snapshot photo) corresponding to the print data.

The controller 250 controls the conveyor 240 and the creasing device 100 in accordance with preset operation commands, thereby forming a straight crease 310 on the printed paper 300 at a specified position such as near an edge portion or a center portion of the paper 300.

Creasing onto Paper 300

Figure 2:
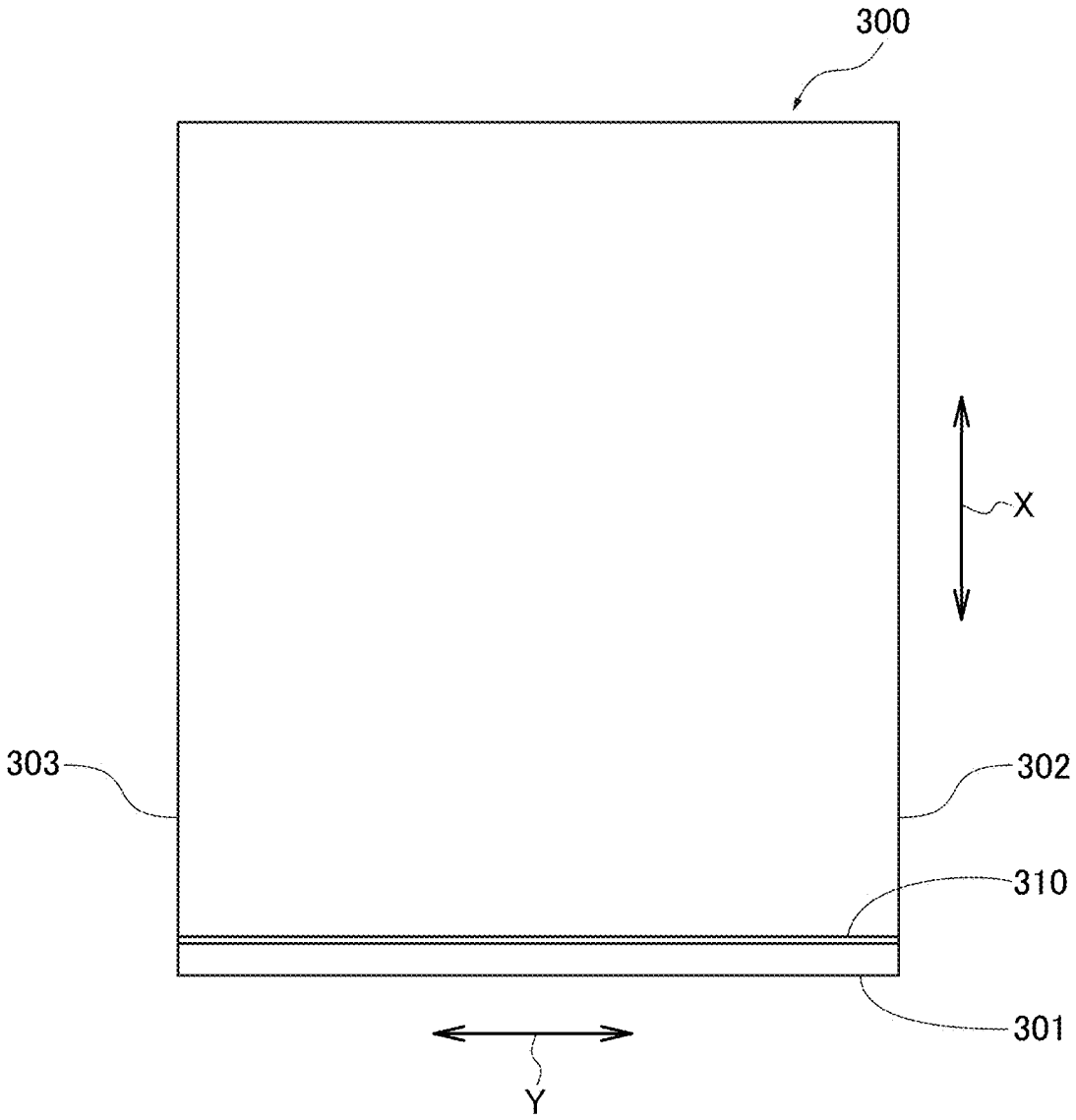
FIG. 2 is a plan view of a sheet of paper with a width-directional crease formed by the creasing device.
Figure 3:
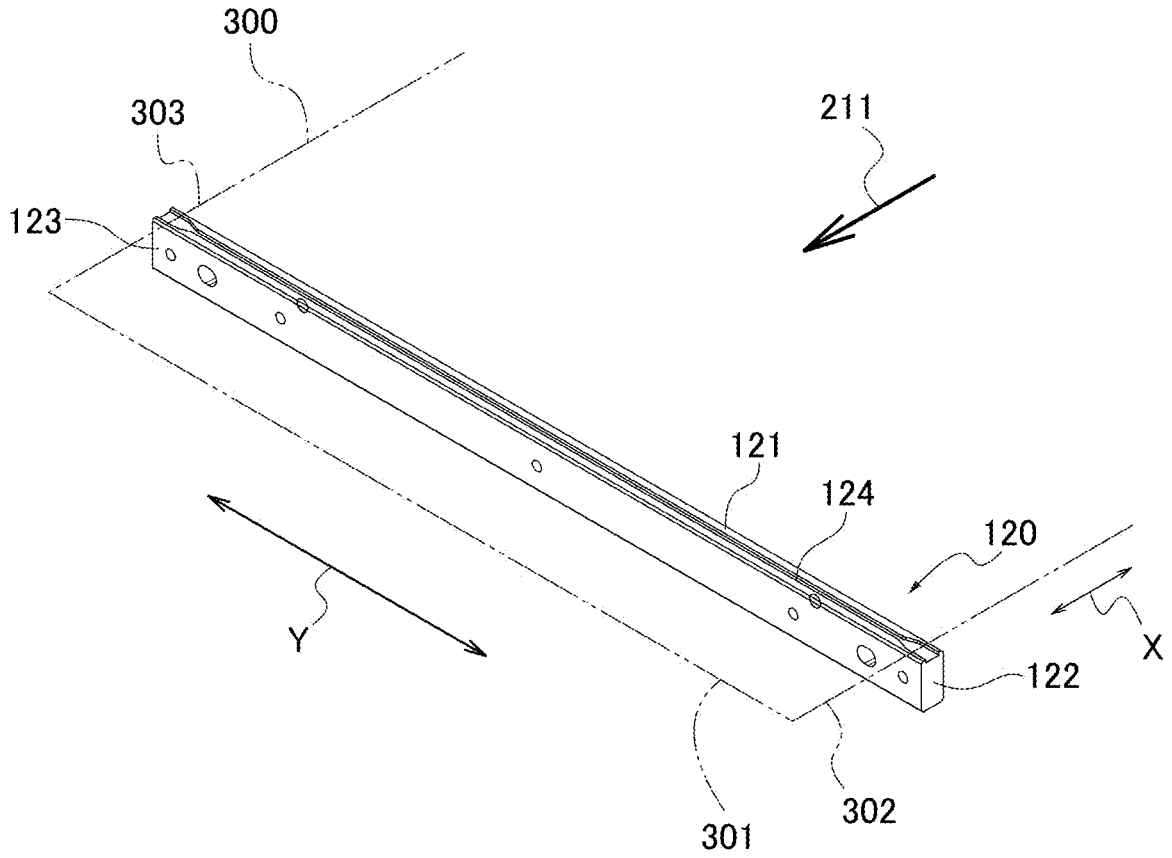
FIG. 3 is a perspective view showing one example of the receiving member provided in the creasing device.

FIG. 2 is a plan view of the paper 300 with the crease 310 in a width direction Y formed by the creasing device 100. For example, the creasing device 100 forms, on the paper printed by the printing section 230, the straight crease 310, which extends in the width direction Y (direction perpendicular to a transport direction X), near the front edge 301 in the transport direction X by the conveyor 240. The crease 310 is not limited to near the front edge 301 in the transport direction X of the paper 300. For example, it may be formed on the center portion or near the rear edge in the transport direction X of the paper 300.

This crease 310 is an indentation that induces a trace of folding along a fold of the paper 300. As shown in the perspective view of FIG. 3, the crease 310 is formed in a condition that the paper 300 is placed on a receiving member 120 formed with a groove 124. Under this condition, as shown in the vertical cross-sectional view of FIG. 4, a rotary blade 135 is brought into abutment at its blade portion (flange portion 135*c*) with a part of the groove 124 from above the paper 300 such that a part of the blade portion is inserted into the groove 124. With this, the crease 310 is formed on the paper 300.

Overall Configuration of Creasing Device 100

Figure 5:
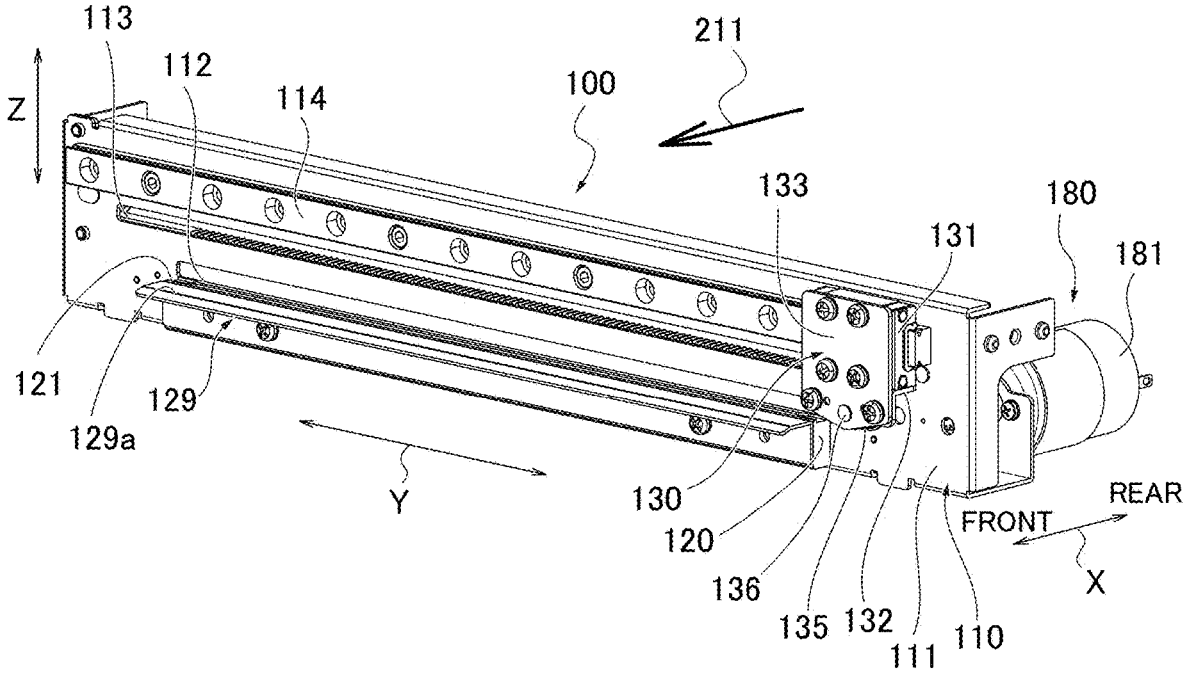
FIG. 5 is a front perspective view of the creasing device formed into a module.
Figure 6:
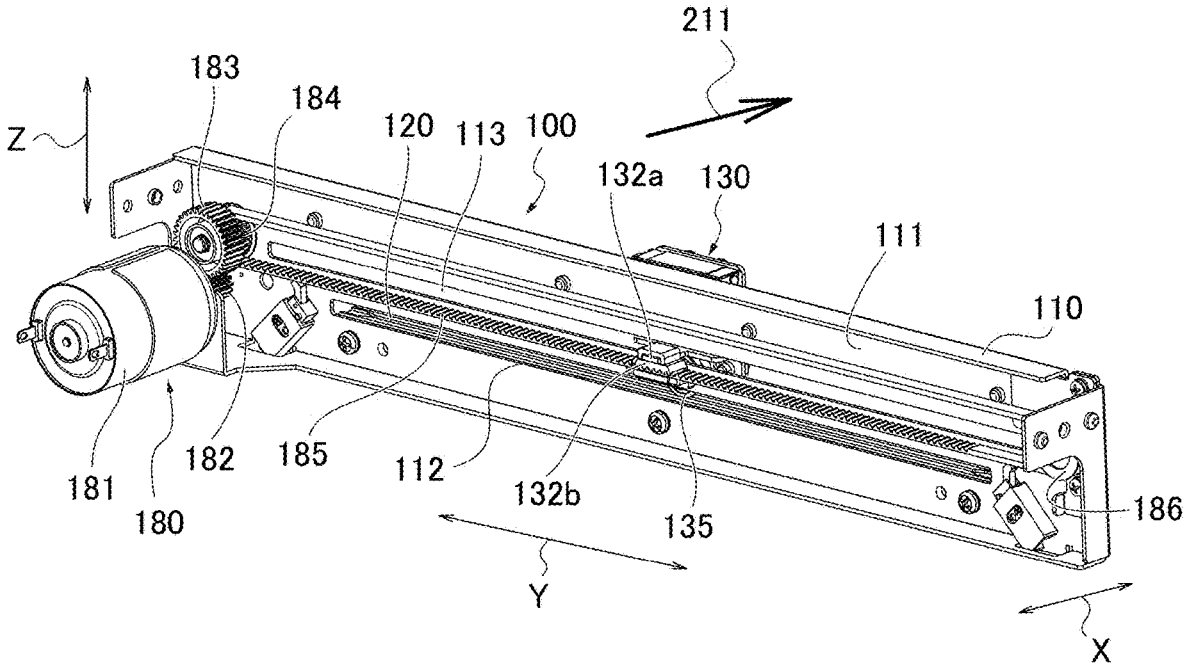
FIG. 6 is a rear perspective view of the creasing device of FIG. 5.
Figure 7:
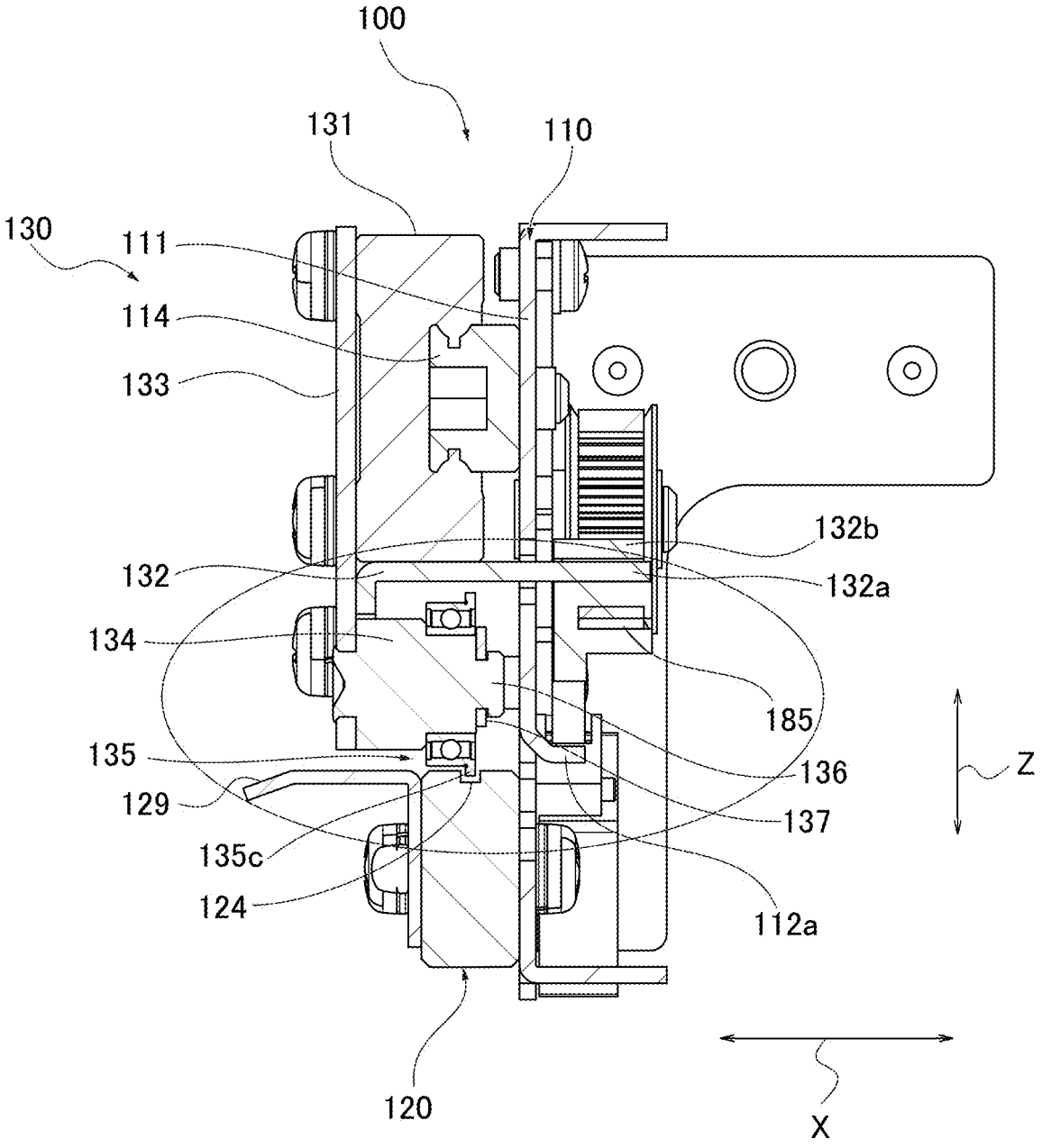
FIG. 7 is a vertical cross-sectional view at a position of a rotary blade unit in the creasing device of FIG. 5.

FIGS. 5 to 7 are views showing the creasing device 100 of this embodiment.

Figure 8A:
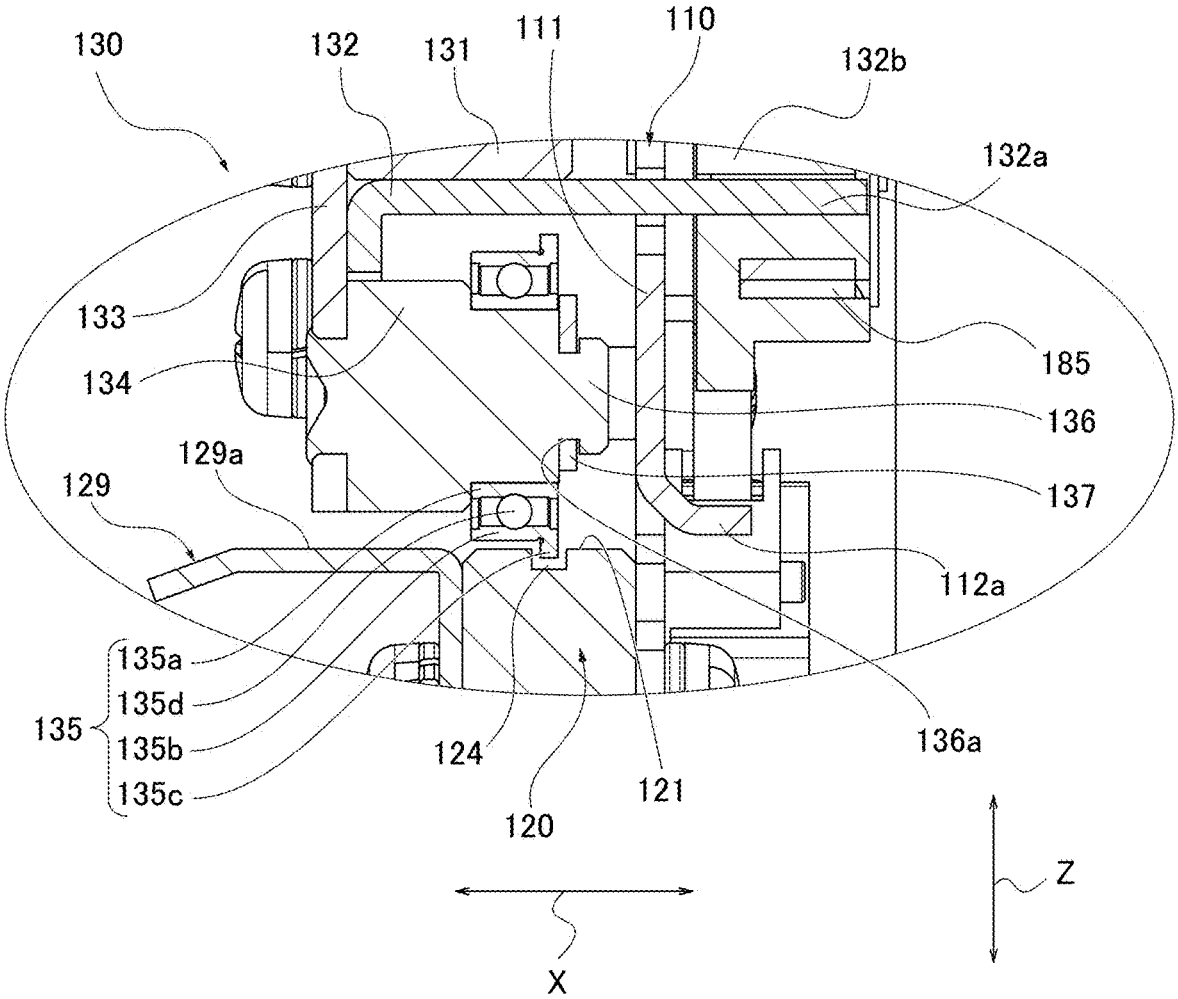
FIG. 8A is a partial enlarged view of FIG. 7.
Figure 8B:
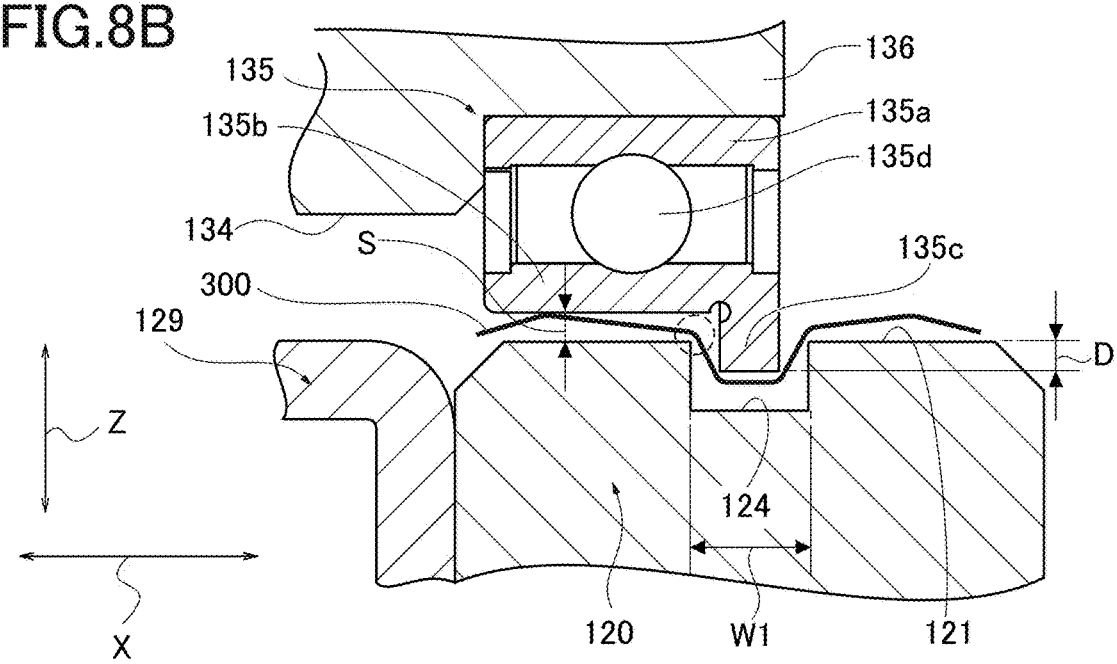
FIG. 8B is a partial enlarged view of FIG. 8A.

FIG. 5 is a front perspective view of the creasing device 100. FIG. 6 is a rear perspective view of the creasing device 100 shown in FIG. 5. FIG. 7 is a vertical cross-sectional view of the creasing device 100 of FIG. 5. FIG. 8A is a partial enlarged view of FIG. 7. FIG. 8B is a partial enlarged view of FIG. 8A.

In the following, for clarity in relation to FIG. 1, the front of the creasing device 100 is described as the downstream side in the transport direction X of the paper 300 in the printer 200, and the rear of the creasing device 100 as the upstream side in the transport direction X. However, the creasing device 100 may be oriented in the opposite direction. That is, the front of the creasing device 100 may refer to the upstream side in the transport direction, and its rear side to the downstream side in the transport direction.

As mainly shown in FIG. 5, the creasing device 100 includes the receiving member 120 (FIG. 3) of the paper 300, a rotary blade unit 130 (FIG. 9), and a moving mechanism 180, which are provided on a sheet metal frame 110 as a main body. These receiving member 120, rotary blade unit 130 and moving mechanism 180 are provided on the frame 110 and formed into a module. By incorporating such module into the printer 200, the printer 200 is provided with a creasing function.

The frame 110 is a member extending in the width direction Y of the paper 300. The frame 110 includes a longitudinal plate 111 that is raised in an approximately vertical direction including the width direction Y of the paper 300. The longitudinal plate 111 is formed to have a relatively flat surface of a rectangular shape that is horizontally elongated in the width direction Y. This longitudinal plate 111 is formed at its lower part with an elongated hole 112 that passes therethrough and extends in the width direction Y. The elongated hole 112 serves as a passing slot of the paper 300 that allows the paper 300 in a flat state to pass therethrough along the transport direction X. The paper 300 is allowed to pass through the elongated hole 112 from the upstream side to the downstream side in the transport direction X. However, the creasing device 100 can also allow the paper 300 to pass through the elongated hole 112 from the downstream side to the upstream side in the transport direction X. In the drawing, the paper 300 is approximately horizontal in the width direction Y and the transport direction X, but it is not limited to this. When the paper 300 is allowed to pass through the elongated hole 112 in an orientation other than horizontal, the creasing device 100 is changed in its overall posture to match the orientation of the paper 300.

The longitudinal plate 111 is formed, above the elongated hole 112, with a guide hole 113 that is parallel with the elongated hole 112, is spaced and passes therethrough. The guide hole 113 is formed to have a length that is longer than the elongated hole 112 in the width direction Y. The longitudinal plate 111 is provided, above the guide hole 113 on its front side, with a guide rail 114 along the guide hole 113. In the drawing, the frame 110, the elongated hole 112, the guide hole 113, and the guide rail 114 extend approximately in a horizontal direction. The front surface of the longitudinal plate 111 is a surface that faces the downstream side of the transport direction X. The guide rail 114 extends in parallel with the elongated hole 112 and the guide hole 113 and has a guiding function together with the guide hole 113.

Configuration of Receiving Member 120, Etc

The receiving member 120 (FIG. 3) of the paper 300 is integrally fixed, together with the after-mentioned paper guide member 129 (FIG. 4), to the underside of the elongated hole 112 at the lower part on the front surface in the transport direction X of the longitudinal plate 111 of the frame 110. The receiving member 120 is formed into a square pillar shape extending long in the width direction Y of the paper 300. The receiving member 120 has a length in the longitudinal direction (width direction Y) that is slightly longer than the width of the paper 300. The receiving member 120 is fixed approximately flush to make its upper surface 121 along the lower edge of the elongated hole 112.

On the upper surface 121 as one side of the square pillar of the receiving member 120, the paper 300 is placed. The receiving member 120 is formed on its upper surface 121 with the groove 124 that extends straight along the longitudinal direction of the receiving member 120. The groove 124 is formed approximately at a center portion in the transport direction X on the upper surface 121 of the receiving member 120. Details of the groove 124 are described hereinafter.

The paper guide member 129 is fixed to the front side surface in the transport direction X of the receiving member 120. The paper guide member 129 has the same length as that of the receiving member 120. The paper guide member 129 is formed, in a cross-section along a vertical plane including the transport direction X, into a generally L-shape that includes vertical and horizontal portions and is installed in an upside-down state. The paper guide member 129 is fixed, at its vertical plate corresponding to the vertical portion of the L-shape, to the front side surface of the receiving member 120. In the paper guide member 129, a horizontal plate corresponding to the horizontal portion of the L-shape is arranged to protrude forward in the transport direction X.

An upper surface 129*a* of the horizontal plate of the paper guide member 129 is set, at least at its portion on the side of the receiving member 120, to approximately the same height as that of the upper surface 121 of the receiving member 120. The upper surface 129*a* of the horizontal portion of the paper guide member 129 may be monolithically formed, at its front portion in the transport direction X, with an inclined surface that slopes down toward the front. The paper 300 is fed, for example, through the elongated hole 112 formed in the frame, to the upper surface 121 of the receiving member 120 and the upper surface 129*a* of the paper guide member 129. When the paper 300 proceeds from the upper surface 121 of the receiving member 120 to the upper surface 129*a* of the paper guide member 129, the front edge 301 (FIG. 2) of the paper 300 proceeds smoothly to the upper surface 129*a* without being caught by the longitudinal plate 111 of the paper guide member 129, thereby guiding a lower surface of the paper 300. Contrary to the above, the paper 300 may be allowed to pass through the elongated hole 112 via the receiving member 120 from the side of the paper guide member 129.

Configuration of Rotary Blade Unit 130

Figure 9:
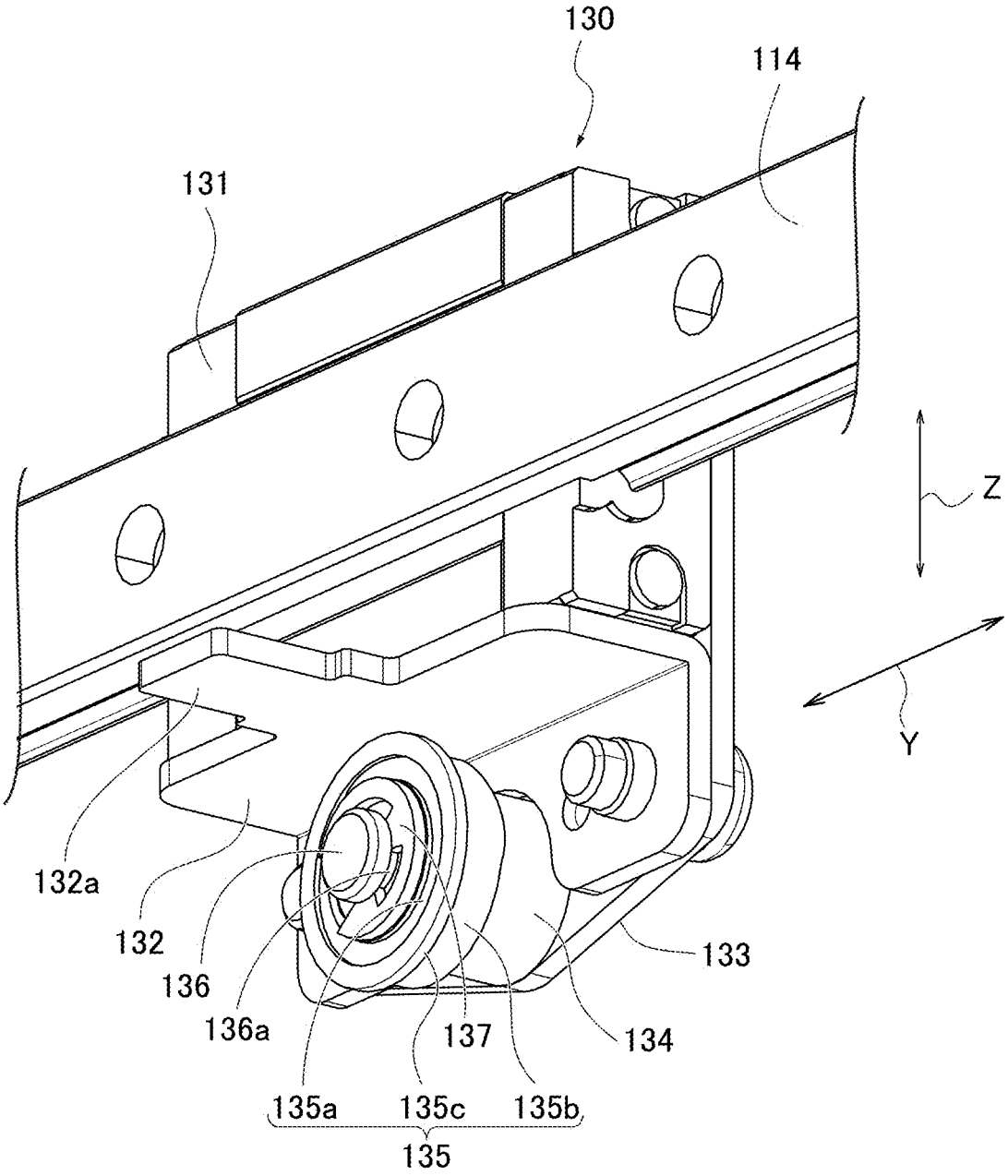
FIG. 9 is a rear perspective view of the rotary blade unit.

FIG. 9 is a perspective view showing the rotary blade unit 130, which is a view seen from the side of the longitudinal plate 111. The rotary blade unit 130 is disposed on the front side in the transport direction X (same side as that of the receiving member 120) of the longitudinal plate 111 of the frame 110 (FIGS. 5 and 7).

The rotary blade unit 130 includes a guided member 131, a holding plate 133, and a support shaft 136. The support shaft 136 is a shaft for rotatably supporting the rotary blade 135. The support shaft 136 is attached to the holding plate 133, and the rotary blade 135 is attached to be rotatable around the support shaft 136. The rotary blade unit 130 includes an engaging plate 132. The rotary blade unit 130 integrally includes the guided member 131, the holding plate 133, the support shaft 136, the rotary blade 135, and the engaging plate 132.

The guided member 131 is a movable body that is movable, without play, along the longitudinal direction (width direction Y) of the guide rail 114, and is slidably engaged with the guide rail 114. The guide rail 114 and the guided member 131 function as a linear guide (guide portion) that linearly guides the rotary blade unit 130 in its entirety at a constant height along the width direction Y. The guided member 131 is installed on a surface on the same side as that of the receiving member 120 of the longitudinal plate 111.

The holding plate 133 is directly fixed to the front surface in the transport direction X of the guided member 131. The holding plate 133 is a member that attaches the rotary blade 135 and the engaging plate 132 to the guided member 131. The holding plate 133 is made to have a relatively flat surface and is disposed in parallel with the longitudinal plate 111. The holding plate 133 is formed to be vertically longer than the guided member 131.

The holding plate 133 is installed to make a condition in which its upper portion is approximately aligned with an upper portion of the guided member 131 and to project its lower portion downwardly from a low portion of the guided member 131. A lower end portion of the holding plate 133 is installed at a position that is opposite the upper surface 129*a* of the paper guide member 129, not to reach the upper surface 129*a* of the paper guide member 129. An end portion of the support shaft 136, which extends rearward (side of the longitudinal plate 111) along the transport direction X, is press-fitted into a downwardly projecting portion of the holding plate 133, and is fixed by swaging so as to extend the press-fitted portion in a radial direction.

As shown in the partial enlarged cross-sectional views of FIGS. 8A and 8B, the support shaft 136 is a stepped shaft member. In the support shaft 136, a base portion, which is closer to the holding plate 133, in a portion (projection portion) projecting rearward from the holding plate 133 is a position setting portion 134 that sets the position of the rotary blade 135 in the transport direction X. The position setting portion 134 is formed into a cylindrical shape with the largest diameter in the support shaft 136, and is installed on the holding plate 133 such that the lowest position in the height direction Z (or vertical direction) of the creasing device 100 becomes approximately the same position as that of the lower end portion of holding plate 133.

The support shaft 136 is formed at its middle portion, which is ahead of the position setting portion 134, with a cylindrical middle-diameter portion, and at its tip with a cylindrical small-diameter portion. The position setting portion 134 is monolithically formed with the middle-diameter and small-diameter portions. The projection portion of the support shaft 136 is largely formed with almost three steps. The end portion of the support shaft 136, which is press-fitted into the holding plate 133, has approximately the same diameter as that of the small-diameter portion at the tip. The position setting portion 134 and the small-diameter portion are not limited to a cylindrical shape.

The rotary blade 135 is fitted around the middle-diameter portion of the support shaft 136 to be rotatable around the support shaft 136. The middle-diameter portion is a shaft support portion with approximately the same diameter as an inner diameter of the rotary blade 135. The middle-diameter portion has a length that is approximately equivalent to the total thickness of the rotary blade 135. The rotary blade, which is fitted around the middle-diameter portion, is positioned by the position setting portion 134 in the axial direction in a locked condition in the axial direction by bringing a side surface, which faces the side of the holding plate 133, into abutment with a stepped portion (locking surface) at a boundary between the position setting portion 134 of the support shaft 136 and the middle-diameter portion. The rotary blade 135 is fixed in a condition that a side surface facing the side of the frame 110 is locked in the axial direction by a retaining ring, such as E-ring 137, which is attached to a receiving groove 136*a* formed between the small-diameter portion and the middle-diameter portion.

In this embodiment, the rotary blade 135 is configured by a radial bearing with the flange portion 135*c* that is monolithically formed. The radial bearing is a bearing member that reduces the frictional force against rotation by having bearing balls 135*d* between inner and outer races 135*a*, 135*b* that are cylindrical in shape. In the radial bearing, the inner race 135*a* of a small diameter is fitted to the middle-diameter portion of the support shaft 136 such that the outer race 135*b* of a large diameter is rotatably installed around the support shaft 136. The radial bearing is held in a locked condition with high precision in the axial direction in which both side surfaces of the inner race 135*a* are sandwiched between the E-ring 137 and the position setting portion 134. The outer race 135*b* is installed relative to the inner race 135*a* such that the positions of their both side surfaces are almost aligned with each other in the axial direction.

The flange portion 135*c* of an annular shape, which projects externally in the radial direction of the radial bearing, is monolithically formed with the outer race 135*b* of the radial bearing. Originally, the flange portion 135*c* is formed on the outer race 135*b* to conduct at least one of locking and positioning in the axial direction relative to a component or member that fixes the outer race 135*b* of the radial bearing.

The flange portion 135*c* is formed on an end portion of the outer race 135*b*, which is on the side of the longitudinal plate 111, and extends continuously with a constant projection in the radial direction. Therefore, a portion except the flange portion 135*c* on an outer circumferential surface of the outer race 135*b* is on the side of the holding plate 133 than the flange portion 135*c* and is positioned to be slightly upwardly away from the upper surface 121 of the receiving member 120. Lower end portions of the outer race 135*b* and the flange portion 135*c* become lower than a lower end portion of the position setting portion 134.

The projection in the radial direction of the flange portion 135*c* is made to be around the thickness of the outer race 135*b*. An outer peripheral portion and its surrounding area of the flange portion 135*c* are used as a cutting portion (blade) of the rotary blade 135, instead of the original use for locking, positioning, etc. The outer peripheral portion of the flange portion 135*c* is used as a cutting edge portion to form the crease 310 on the paper 300 by a direct abutment with the paper 300.

The flange portion 135*c* has a cylindrical surface with a constant thickness (blade thickness W3, FIG. 4) in the transport direction X. The cylindrical surface is a surface that is parallel with the axial direction and extends in the circumferential direction, thereby making a flat cutting edge. The blade thickness W3 of the flange portion 135*c* is roughly equivalent to the thickness of the outer race 135*b*. The outer peripheral portion of the flange portion 135*c* is chamfered at its corner portions. Therefore, the flange portion 135*c* is suitable for the use to form the crease 310 on the paper 300, without cutting the paper 300. For example, if the outer peripheral portion of the outer race 135*b* is sharpened by cutting work, the creasing device 100 can also be used as a device for cutting the paper 300.

When the rotary blade 135 moves along the width direction Y by the above-mentioned linear guide, the flange portion 135*c* moves with rotation along the groove 124, while a part of the outer peripheral portion is kept inserted in the groove 124 of the receiving member 120. In other words, in the creasing device 100, the outer peripheral portion of the flange portion 135*c* penetrates into the groove 124 to press the paper 300, thereby achieving a creasing function. The width (groove width W1) of the groove 124 is formed to be greater than the blade thickness W3 along the transport direction X of the flange portion 135*c* (groove width W1>blade thickness W3).

Although the blade thickness W3 is 0.5 to 0.6 [mm] as one example, it is not limited to 0.5 to 0.6 [mm] as its specifically applicable value. The flange portion 135*c* is installed such that the center of the blade thickness W3 is aligned with the center of the groove width W1 mainly by setting the axial length of the position setting portion 134 and that the flange portion 135*c* moves along the groove 124 under a condition of alignment of the centers.

In the flange portion 135*c* of the rotary blade 135, the lower end portion of the outer peripheral portion is lower than the upper surface 121 of the receiving member 120. As one example, the projection in the radial direction of the flange portion 135*c* is 0.5 to 0.6 [mm]. The lower end portion of the flange portion 135*c* is set to be disposed at a position that is lower than the upper surface 121 of the receiving member 120 by 0.1 to 0.2 [mm] (insertion D). When the rotary blade 135 moves in the width direction Y, the rotary blade 135 moves along the groove 124 in a condition that the lower end portion of the flange portion 135*c* is inserted in the groove 124 by 0.1 to 0.2 [mm].

In contrast, in the rotary blade 135, the lower end portion of the outer circumferential surface of the outer race 135*b*, except the flange portion 135*c*, is higher than the upper surface 121 of the receiving member 120 to form a gap S (FIG. 8B) between that and the upper surface 121. This gap S has a size that allows the paper 300 to pass therethrough and that suppresses rising of the paper 300 from the upper surface 121 of the receiving member 120 during the creasing. In other words, even if the paper 300 is tried to rise from the upper surface 121 by more than the gap S, the paper 300 is brought into abutment with the outer circumferential surface of the outer race 135*b* to prevent the paper 300 from rising. Thus, the outer circumferential surface of the outer race 135*b* acts as a rising prevention portion that prevents the paper 300 from rising. As one example, the gap S is 0.4 to 0.5 [mm] relative to the paper 300 having a thickness of 0.2 [mm].

Similar to the lower end portion of the outer peripheral surface of the outer race 135*b*, according to need, the elongated hole 112 may be formed, at its upper peripheral portion, with a rising prevention portion 112*a* (FIG. 8A) that prevents the paper 300 from rising during the creasing. This rising prevention portion 112*a* extends from the upper peripheral portion of the elongated hole 112 downward or diagonally downward toward the opposite side of the receiving member 120 to have about a length that does not reach the upper surface of the paper 300 which passes through the inside of the elongated hole 112. The rising prevention portion 112*a*, which extends diagonally downward or the like, functions as a guiding taper for the paper 300. Furthermore, the rising prevention portion 112*a* may be formed, at its lower end portion, with a parallel portion that is parallel with the upper surface 121 of the receiving member 120.

Figure 12:
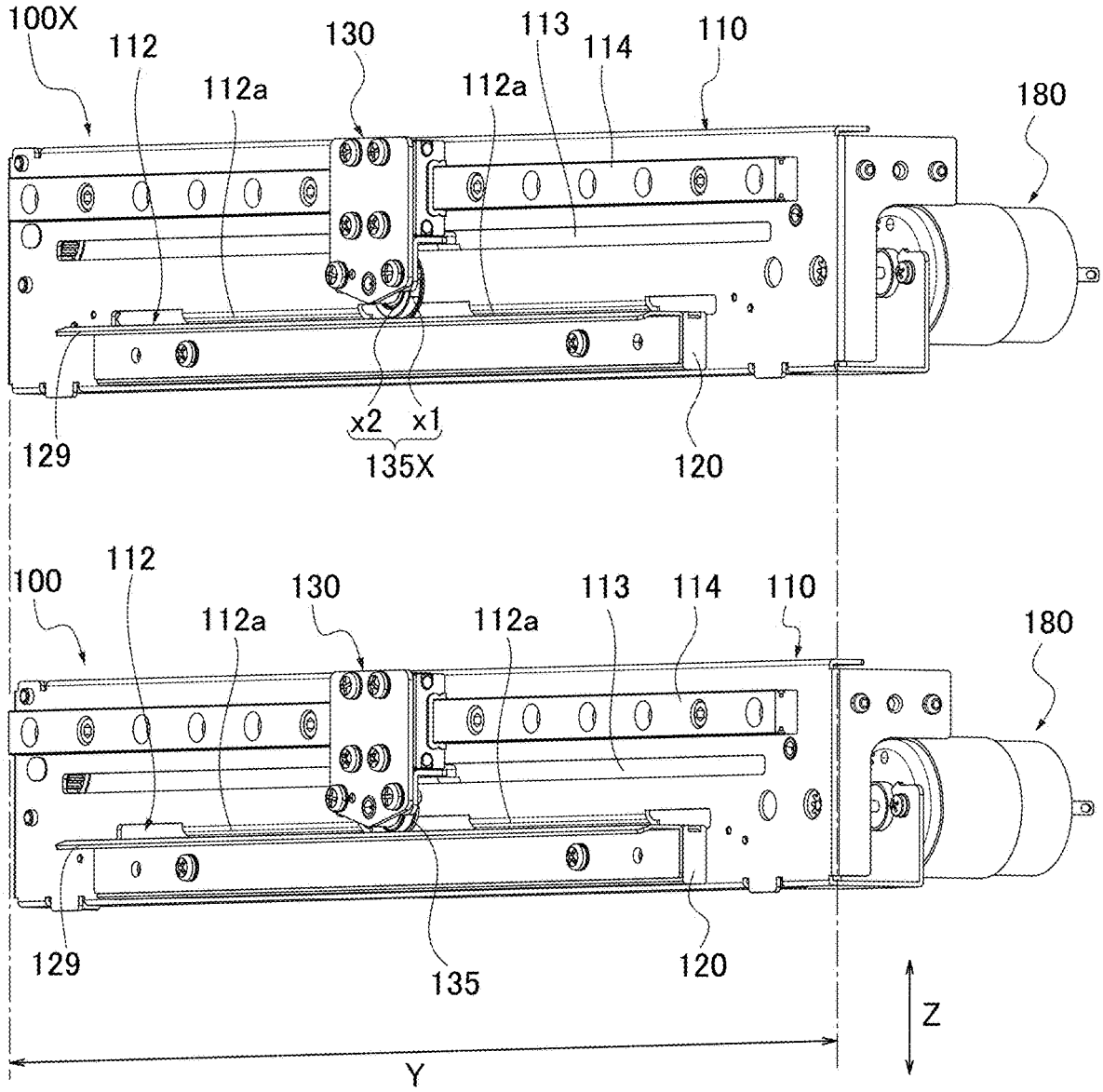
FIG. 12 is a comparative perspective view of a creasing device of an embodiment and that of a comparative example, which are in alignment.
Figure 13:
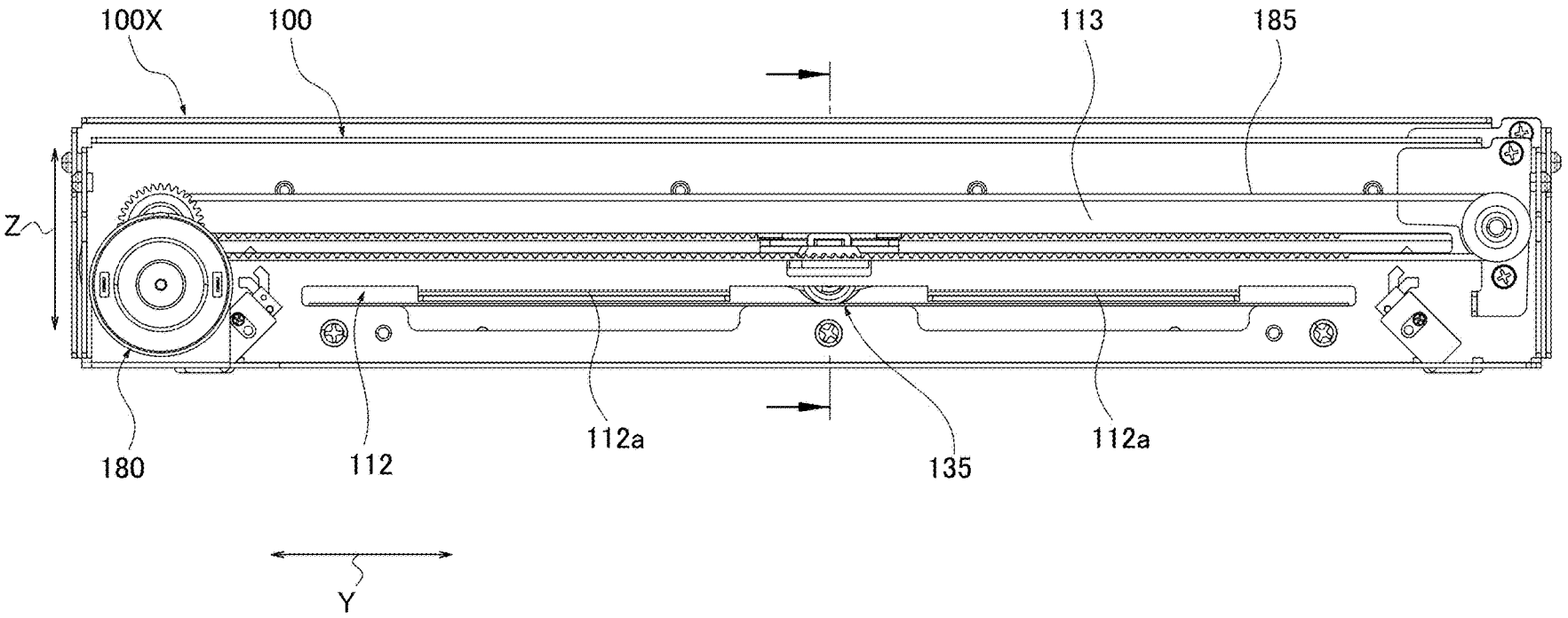
FIG. 13 is a comparative back view showing a height comparison between the creasing device of the embodiment and that of the comparative example, which are in alignment.
Figure 14A:
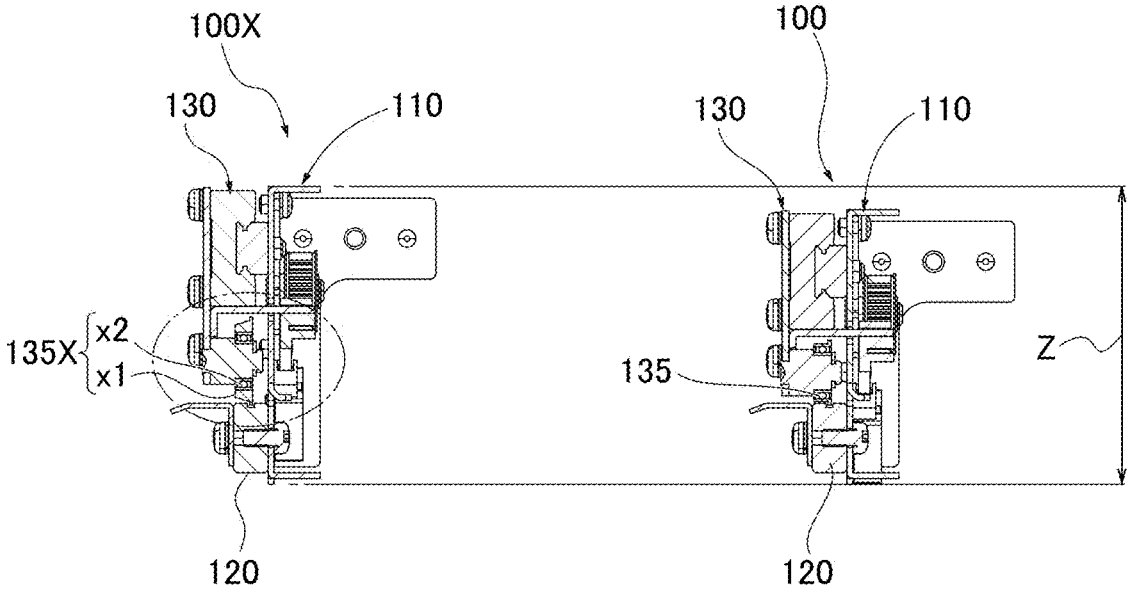
FIG. 14A is a comparative vertical cross-sectional view showing a height comparison between the creasing device of the embodiment and that of the comparative example, which are in alignment.
Figure 14B:
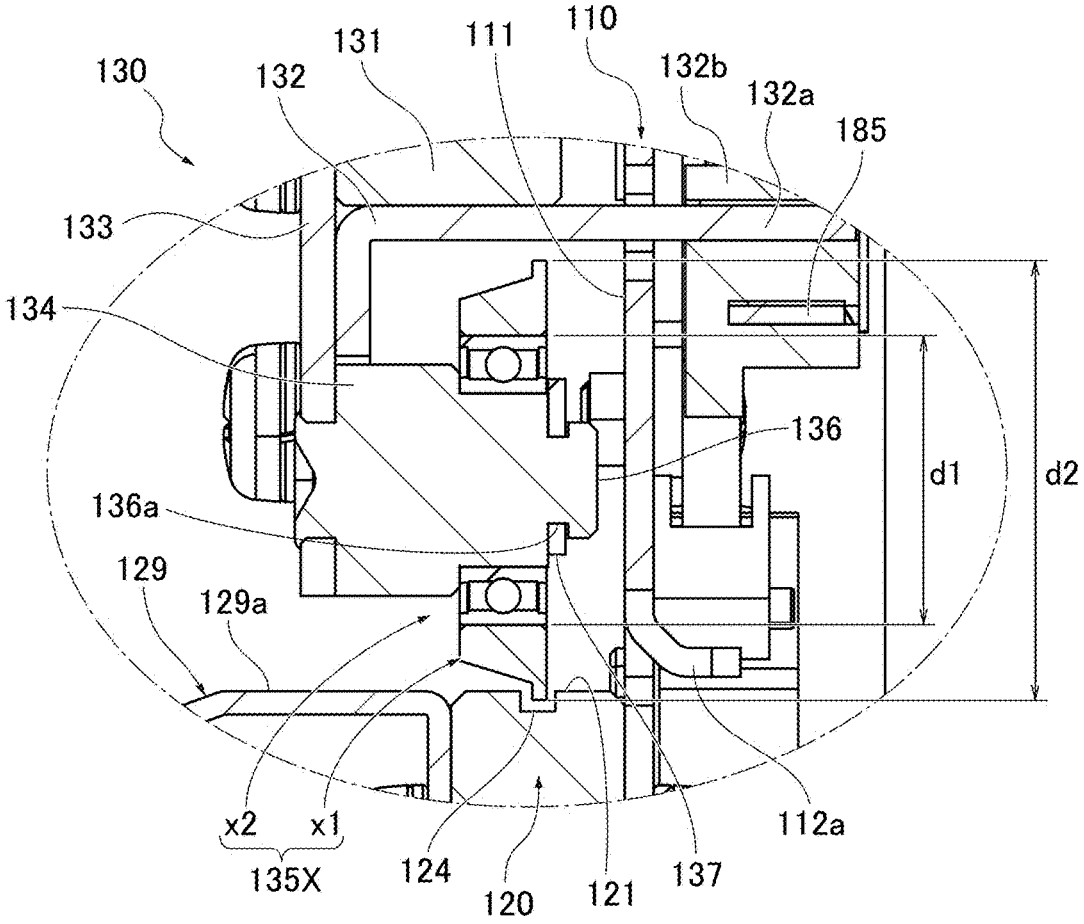
FIG. 14B is a partial enlarged view of the comparative example of FIG. 14A, which is similar to FIG. 8A.
Figure 15:
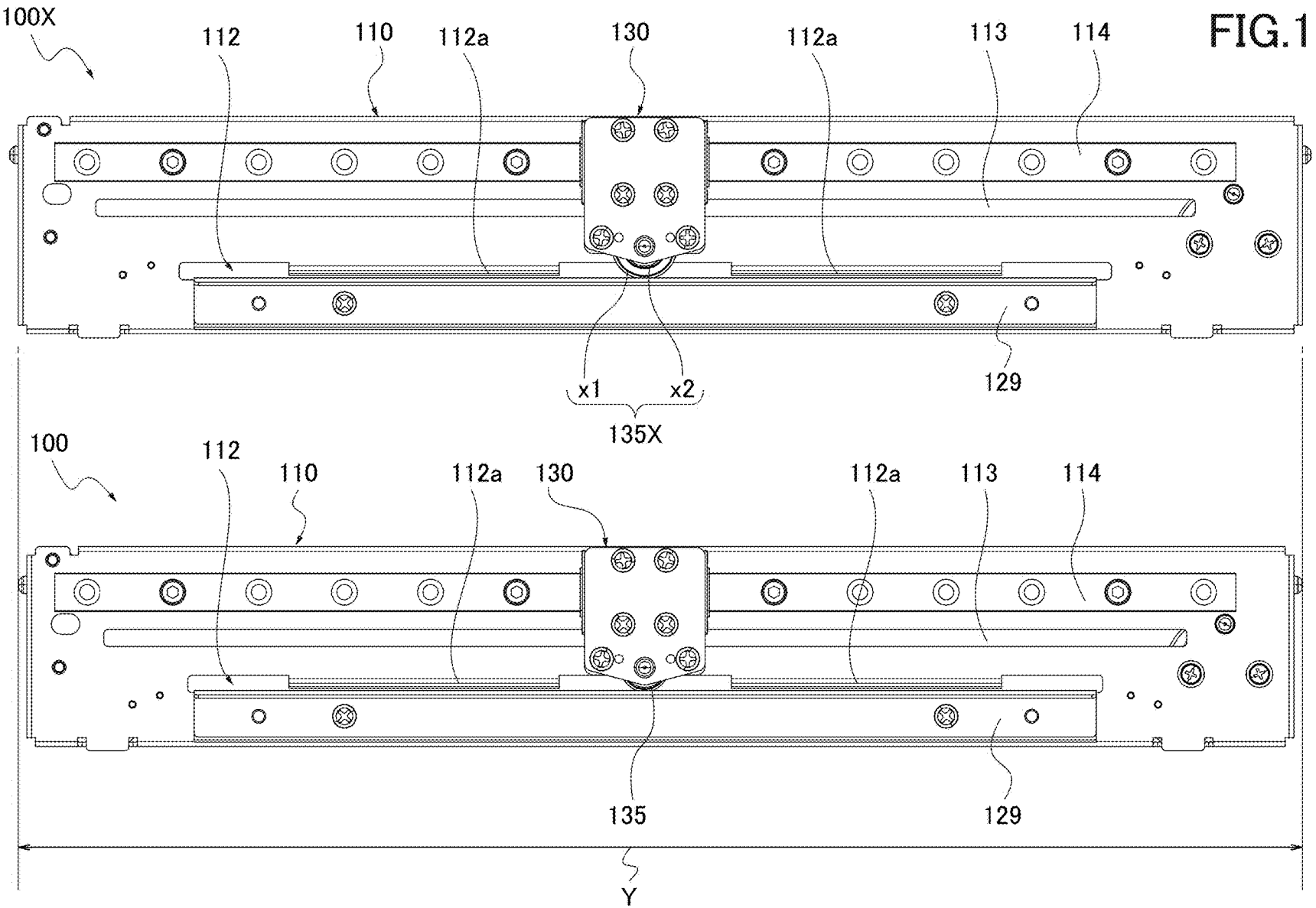
FIG. 15 is a comparative front view showing a width comparison between the creasing device of the embodiment and that of the comparative example, which are in alignment.

The rising prevention portion 112*a* is provided on a part of the upper peripheral portion of the elongated hole 112. As shown in FIG. 12, the rising prevention portion 112*a* is provided at two positions except both end portions and a center portion of the elongated hole 112. For example, when the rising prevention portion 112*a* is formed by a cutting and bending process through pressing, a partial shallow cutout portion for securing a part that becomes the rising prevention portion 112*a* is formed at a position of a lower peripheral portion of the elongated hole 112, where the rising prevention portion 112*a* is provided. This shallow cutout portion is covered by a side surface of the receiving member 120. Therefore, there is no obstacle to make the paper 300 pass through the elongated hole 112.

Configuration of Movable Part of Creasing Device 100

As shown in FIG. 9, the rotary blade unit 130 becomes a movable part of the creasing device 100. To make the rotary blade unit 130 movable, the engaging plate 132 is fixed to a downwardly projecting portion of the holding plate 133 attached to the guided member 131. The engaging plate 132 is attached to a position that is higher than that of the rotary blade 135.

The engaging plate 132 is formed into a generally L-shape including vertical and horizontal portions in a cross-section taken by a vertical plane including the transport direction X, and is installed in an upside-down state. In the engaging plate 132, a vertical plate corresponding to the vertical portion of the L-shape is fixed in a horizontal direction in an abutment condition with the holding plate 133, and a horizontal plate corresponding to the horizontal portion of the L-shape is engaged in abutment with a lower part of the guided member 131 from below. The vertical plate corresponding to the vertical portion of the L-shape is formed with an arcuate cutout for preventing interference with the position setting portion 134. The horizontal plate corresponding to the horizontal portion of the L-shape is formed with an engaging portion 132*a* that projects rearward in the transport direction X. The engaging portion 132*a* is formed at a center portion in the width of the horizontal plate.

The engaging portion 132*a* passes through the guide hole 113 formed through the longitudinal plate 111 of the frame 110 and projects on the back side of the longitudinal plate 111. As shown in FIG. 6, the engaging portion 132*a* is fixed to an endless timing belt 185 that is displaced along an outer circumference of the guide hole 113.

With this, the rotary blade unit 130 moves along the width direction Y in accordance with the displacement of the timing belt 185. The rotary blade unit 130 moves, while maintaining a horizontal state. The flange portion 135*c*, which functions as a blade portion of the rotary blade 135, is made to be movable along the groove 124 without changing the position in the height direction Z relative to the groove 124 of the receiving member 120.

The moving mechanism 180 includes a drive source that automatically moves the rotary blade 135 along the groove 124. The moving mechanism 180 is disposed on the back surface side of the longitudinal plate 111 of the frame 110. The moving mechanism 180 includes a DC motor 181 and a pinion gear 182 fixed to an output shaft of the DC motor 181. The moving mechanism 180 includes an intermediate gear 183 that meshes with the pinion gear 182, a drive pulley 184 that is coaxially provided with the intermediate gear 183, a driven pulley 186 that makes a pair with the drive pulley 184, and a timing belt 185.

The timing belt 185 is formed, on its inner circumferential surface, with a linear tooth profile that meshes with the drive pulley 184 and the driven pulley 186, and is looped over the drive pulley 184 and the driven pulley 186. The drive and driven pulleys 184, 186 are installed at positions outside of both end portions of the guide hole 113 in a state that they are spaced away from each other. The DC motor 181, the pinion gear 182, and the intermediate gear 183 are installed at around an end portion of the guide hole 113, which is on the side of the drive pulley 184.

The timing belt 185 is looped over the drive and driven pulleys 184, 186 which are installed outside the guide hole 113 with a space in the width direction Y, so as to be disposed in a horizontally extended manner to surround the outside of the contour of the guide hole 113. A fixing member 132*b*, which mates with and holds the engaging portion 132*a* projecting rearward in the transport direction X through the guide hole 113, is fixed to the linear tooth profile. The fixing member 132*b* may be installed on either an upper line portion or a lower line portion of the timing belt 185. The upper and lower line portions are horizontally elongated portions along the guide hole 113, which are positioned on the upside and downside of the timing belt 185, and move in the opposite directions relative to each other. In the drawing, the fixing member 132*b* is fixed to the lower line portion of the timing belt 185.

By rotating the output shaft through driving the DC motor 181, the timing belt 185 moves rotationally through the pinion gear 182, the intermediate gear 183, and drive pulley 184. Thus, the rotary blade unit 130, which is fixed to the timing belt 185, moves horizontally at a constant height in the width direction Y along the guide hole 113. The movement range of the rotary blade 135 by the moving mechanism 180 is set to a range from a position outside one end portion 122 in the width direction Y of the receiving member 120 to a position outside the other end portion 123.

By switching the rotational direction of the DC motor 181, the moving mechanism 180 can switch the movement range of the rotary blade 135 to a range from the position outside the other end portion 123 in the width direction Y of the receiving member 120 to the position outside the one end portion 122. Thus, the moving mechanism 180 can reciprocatingly move the rotary blade 135 at a constant height along the width direction Y.

It suffices that the range, in which the rotary blade 135 is moved while maintaining a constant height, is at least the range between the side edges 302, 303 of the paper 300 (range for creasing the paper 300). It is optional to change the height of the rotary blade 135 outside the side edge 302 (or side edge 303) of the paper 300 in the width direction Y.

Configuration of Groove 124 of Receiving Member 120

Details of the groove 124 formed in the receiving member 120 are described in the following.

Figure 4:
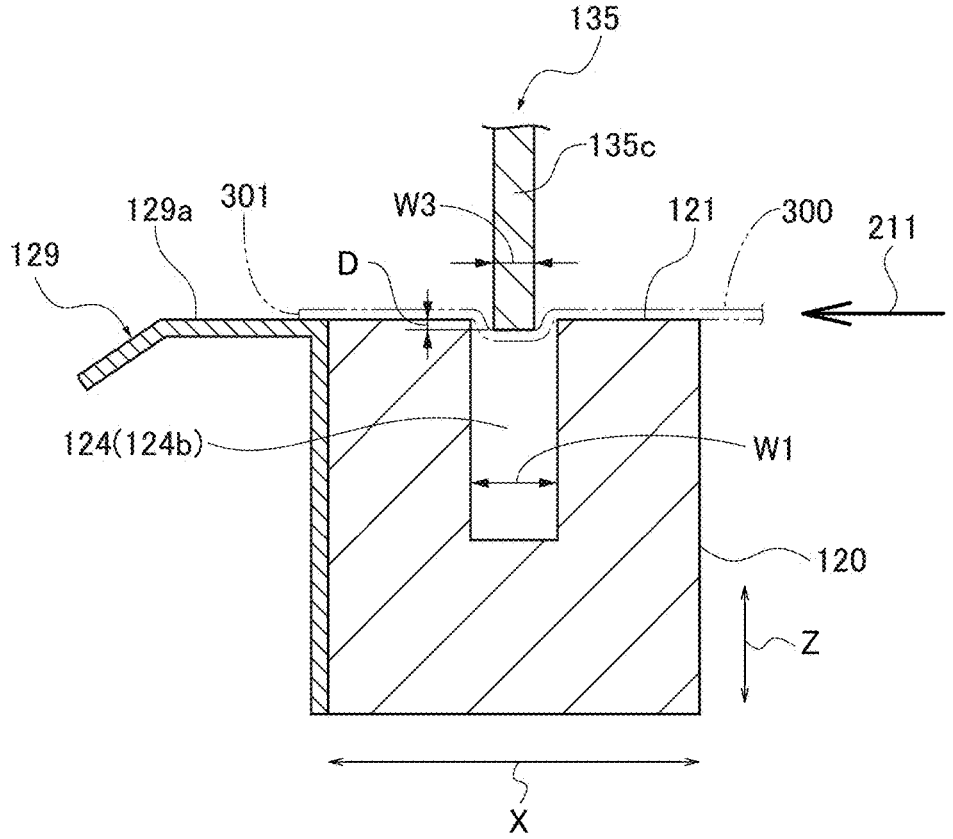
FIG. 4 is a vertical cross-sectional view of a middle portion (position of line B-B in FIG. 10) of the receiving member of FIG. 3.
Figure 10:
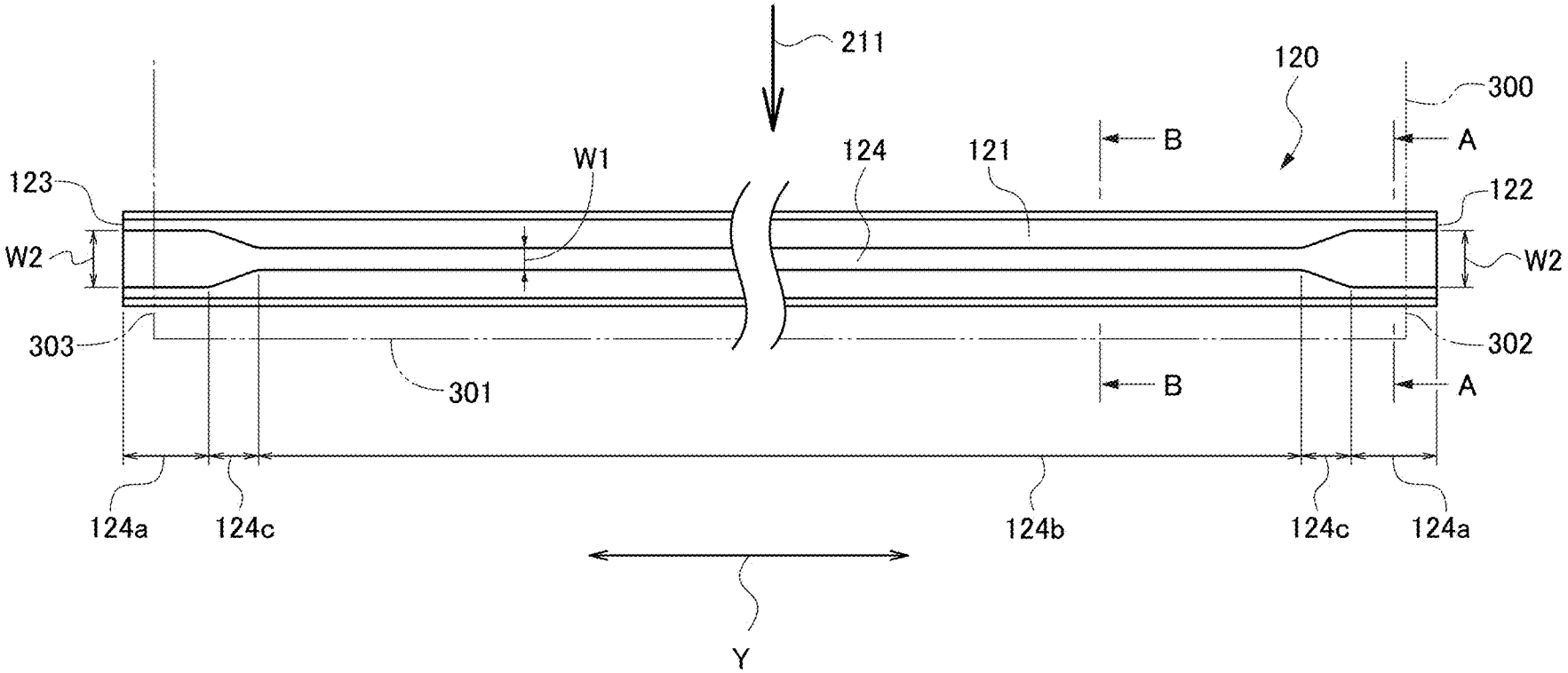
FIG. 10 is a plan view showing the groove formed on an upper surface of the receiving member of FIG. 3.
Figure 11:
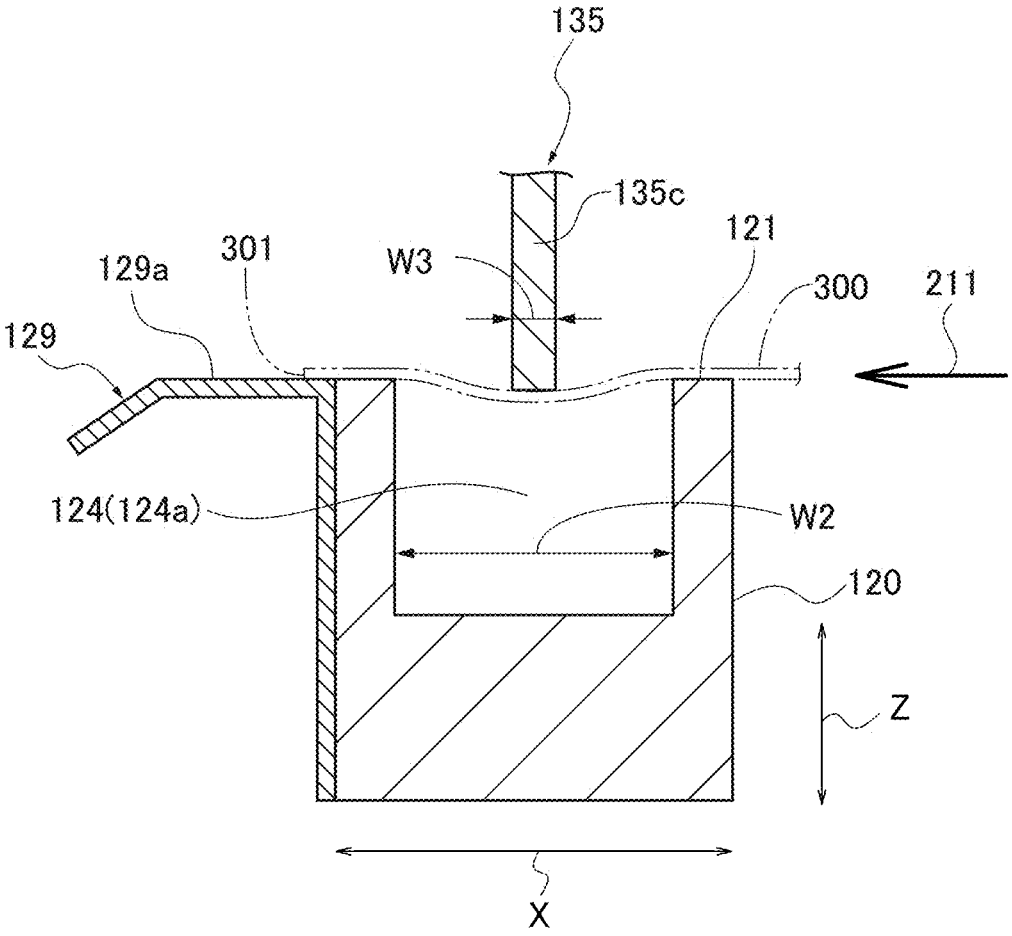
FIG. 11 is a cross-sectional view showing a cross section taken along line A-A in FIG. 10.

FIG. 10 is a plan view showing the groove 124 formed on the upper surface 121 of the receiving member 120. FIG. 11 is a sectional view showing a section taken by a plane along the line A-A (position of an outer range 124*a*) in FIG. 10. FIG. 4 is a sectional view showing a section taken by a plane along the line B-B (position of an inner range 124*b*) in FIG. 10.

The groove 124 of the receiving member 120 may have a uniform width (groove width W1) over the whole length in the width direction Y. However, in this embodiment, the groove is as follows.

Firstly, the paper 300 that has passed the elongated hole 112 is placed on the upper surface 121 of the receiving member 120, as shown by an imaginary line. Upon this, the paper 300 is positioned in the width direction Y such that its entire area in the width direction Y is placed on the upper surface 121.

The one side edge 302 in the width direction Y of the paper 300 is disposed inside the one end portion 122 of the receiving member 120 in the width direction Y. The other side edge 303 (side edge 303 in the width direction Y) of the paper 300 is disposed inside the other end portion 123 of the receiving member 120 in the width direction Y.

In this embodiment, the groove 124 includes at least the outer range 124*a* and the inner range 124*b* in the width direction Y. The inner range 124*b* is a middle portion in the width direction Y that occupies most of the groove 124. The outer range 124*a* is a portion (around the edge) of a range with a predetermined length that is positioned outside the inner range 124*b* in the width direction Y. The outer range 124*a* is formed on at least one or both sides of the side edges 302, 303 of the paper 300.

The outer range 124*a* of the groove 124 includes a starting point (starting point portion) where the rotary blade 135 begins to make a contact with the side edge 302, 303 of the paper disposed on the groove 124. In this embodiment, the side edge 302, 303 of the paper 300 is the starting point portion.

In the groove 124, the inner range 124*b* has a constant groove width W1 (FIG. 4). Although the constant groove width W1 is 1.2 to 1.4 [mm] as one example, it is not limited to 1.2 to 1.4 [mm] as its specifically applicable value.

In the groove 124, the outer range 124*a* has a constant groove width W2 (>groove width W1) that is wider than that of the inner range 124*b* (FIG. 11). Although the constant groove width W2 is 4.0 [mm] as one example, it is not limited to 4.0 [mm] as its specifically applicable value.

In the groove 124, the center of the outer range 124*a* in the groove width direction (transport direction X) and the center of the inner range 124*b* in the groove width direction (transport direction X) are formed to align with each other.

A connecting range 124*c* is formed between the outer range 124*a* and the inner range 124*b* of the groove 124. The connecting range 124*c* has an intermediate width between the groove width W2 of the outer range 124*a* and the groove width W1 of the inner range 124*b*. The connecting range 124*c* changes such that the width of the groove 124 narrows gradually from the outer range 124*a* toward the inner range 124*b*. The center of the connecting range 124*c* in the groove width direction (transport direction X) is aligned with the centers of the outer and inner ranges 124*a*, 124*b* in the groove width direction (transport direction X).

In the connecting range 124*c*, as one example, the width of the groove 124 changes (decreases) proportionally to make a smooth connection from the outer range 124*a* of the wide groove width W2 to the inner range 124*b* of the narrow groove width W1. The portion of the connecting range 124*c* of the groove 124 has a contour with a tapered shape that is inclined straight to the width direction Y.

Operation of Embodiment

Operation of this embodiment is described in the following.

The creasing device 100 having the above configuration makes a condition that the paper 300 is placed on the upper surface 121 of the receiving member 120. Under this condition, the rotary blade 135 moves in the width direction Y, for example, from the one end portion 122 of the receiving member 120 toward the other end portion 123 in the movable range by the moving mechanism 180. With this, the crease 310 is formed on the paper 300, as a trace of the movement of the flange portion 135*c*, at a portion sandwiched between the flange portion 135*c* of the radial bearing as the rotary blade 135 and the groove 124 on the upper surface 121 of the receiving member 120. The rotary blade 135 may form the crease 310 by moving in the width direction Y from the side of the other end portion 123 of the receiving member 120 toward the side of the one end portion 122.

In the creasing device 100, the rotary blade 135 is formed of the radial bearing that is a combination of the inner race 135*a* and the outer race 135*b*, and the blade portion of the rotary blade 135 is the flange portion 135*c*, which is monolithically formed with the outer race 135*b*, of the radial bearing. With this, the creasing device 100 makes it possible to form the rotary blade 135 with the simplest configuration of only the radial bearing and to precisely move the rotary blade 135 along the groove 124.

Here, during the creasing, the rotary blade 135 begins to make a contact, at the flange portion 135*c*, with one of the side edges 302, 303 of the paper 300 in the outer range 124*a* of the groove 124, which is formed with the wide groove width W2 (FIG. 11).

In the groove 124, the groove width W2 of the outer range 124*a* is greater than the groove width W1 (FIG. 4) of the inner range 124*b*. Specifically, the groove width W2 is about three times the groove width W1.

Therefore, the shear force exerted on the paper 300 by being sandwiched between the flange portion 135*c* and the groove 124 is greater in the inner range 124*b* than in the outer range 124*a*. As a result, the crease in the width direction Y, which is formed in a middle portion of the paper 300 in the inner range 124*b*, becomes dark with a clear linear outline.

On the other hand, the shear force exerted on the paper 300 by being sandwiched between the flange portion 135*c* and the groove 124 becomes less in the outer range 124*a* than in the inner range 124*b*. As a result, the crease 310, which is formed around the side edges 302, 303 of the paper 300 in the outer range 124*a*, results in a paler or thinner outline, as compared with the crease 310, which is formed in the middle portion of the paper 300 in the inner range 124*b*.

Here, suppose that the groove 124 is constant with the same groove width W1 over the total length as that in the inner range 124*b* by eliminating the outer range 124*a* with the wide groove width W2 (groove width W2=groove width W1=constant). In this case, when the flange portion 135*c* of the rotary blade 135 begins to make a contact with the side edge 302, 303 of the paper 300, a strong shear force may be caused to the side edge 302, 303 to result in a rupture around the side edge 302, 303 of the paper 300.

Thus, in the creasing device 100 of the present embodiment, the groove width W2 of the outer range 124*a*, which corresponds to the side edge 302, 303 of the paper 300, has been made wider than the groove width W1 of the inner range 124*b*. Therefore, when the flange portion 135*c* begins to make a contact with the side edge 302, 303 of the paper 300, the shear force exerted on the side edge 302, 303 is weakened. Thus, the outer range 124*a* makes it possible to prevent or suppress a rupture around the side edge 302, 303 of the paper 300.

The creasing device 100 of the present embodiment is formed with the connecting range 124*c*, where the width of the groove narrows gradually, between the outer range 124*a* and the inner range 124*b*. Therefore, the shear force exerted on the paper 300 is gradually changed by the connecting range 124*c*, between the outer range 124*a* with the groove width W2 being wide and constant and the inner range 124*b* with the groove width W1 being narrow and constant. Therefore, for example, it is possible to prevent or suppress the stress on the paper 300, which is caused by an abrupt change of the shear force.

In the creasing device of the present embodiment, the center in the groove width direction of the groove 124 in the outer range 124*a* is aligned with that in the inner range 124*b*. With this, the center of the blade thickness W3 of the flange portion 135*c* of the rotary blade 135 does not deviate from the center in the groove width direction of the groove 124, between the outer range 124*a* and the inner range 124*b*, thereby forming the crease 310 in a straight line. Therefore, it is possible to equalize stresses acting on both edges in the width direction of the crease 310, thereby preventing or suppressing a rupture of the paper 300 that can be caused, for example, when the stress is biased on one edge. Similarly, it is possible to obtain the same advantageous effect as above even in the connecting range 124*c* by aligning the center in the groove width direction of the groove 124 in the connecting range 124*c* with those in the outer and inner ranges 124*a*, 124*b*.

Advantageous Effects of Embodiment

The advantageous effects of this embodiment are described in the following.

(1) In a creasing device 100, a rotary blade 135 includes a radial bearing that is formed of a combination of an inner race 135*a* and an outer race 135*b* and that includes a flange portion 135*c* that is monolithically formed with the outer race 135*b*. The radial bearing uses the flange portion 135*c* as a blade portion of the rotary blade 135. The radial bearing is configured to move by a moving mechanism 180, while the radial bearing sandwiches a paper 300 between the flange portion 135*c* and a groove 124 and keeps a condition in which the flange portion 135*c* is inserted in the groove 124.

In other words, the rotary blade 135, which is composed of only the radial bearing, is pressed at (a part of) the flange portion 135*c* against a part of the paper 300, which corresponds to the groove 124, placed on the receiving member 120 to insert the flange portion 135*c* into the groove 124.

With this, it results in a condition that the both surfaces of the paper 300 are sandwiched between the flange portion 135*c* and the groove 124. Under this condition, the moving mechanism 180 makes the flange portion 135*c* of the rotary blade unit 130 move in a rolling manner along the groove 124.

However, it suffices that the radial bearing is configured to be able to sandwich both surfaces of the paper 300 between the flange portion 135*c* and the groove 124. As long as this configuration is maintained, a separate member(s) may be attached to the radial bearing for some purpose(s).

In the radial bearing, the flange portion 135*c*, which is monolithically formed with the outer race 135*b*, serves as a blade portion of the rotary blade 135, and the blade portion (flange portion 135*c*) is moved by the moving mechanism 180. With this, the flange portion 135*c* enters the groove 124 to form the crease 310 in the width direction Y on the paper 300 sandwiched between the flange portion 135*c* and the groove 124.

The radial bearing and the receiving member 120 are arranged in such a positional relationship that the flange portion 135*c* of the outer race 135*b* is used as it is as a blade portion, and the flange portion 135*c* of the radial bearing is used differently from its original use. In this way, the improvement on the use of the radial bearing can make the radial bearing itself act as the rotary blade 135 to directly form the crease 310 on the paper 300.

Generally, the flange portion 135*c* of the radial bearing is provided for the purpose of fixing or positioning the radial bearing to some member. Thus, the outer circumferential surface of the flange portion 135*c* is not sharply formed like a cutting blade. Therefore, the flange portion 135*c* of the radial bearing is suitable for the use to directly form the crease 310 without cutting the paper 300.

Various radial bearings with different widths of the flange portion 135*c* are commercially available. Therefore, it is possible to use a radial bearing with the flange portion 135*c* of a suitable width according to the type or use of the paper 300 which can be printed. In this case, as the receiving member 120, it is advisable to use one having the groove 124 that matches with the width of the flange portion 135*c* of the radial bearing to be used.

For example, FIGS. 12 to 15 are views showing a side-by-side size comparison between the creasing device 100 of this embodiment and a creasing device 100X of a comparative example. The comparative example has a hypothetical configuration, which is created based on the present embodiment, and does not actually exist. FIGS. 12 to 15 include only minimal signs. As shown in the partial enlarged view of FIG. 14B, the creasing device 100X of the comparative example is one in which a rotary blade 135X is configured by attaching a separate component x1 (ring blade) as a blade portion to an outer circumference of a radial bearing x2. The radial bearing x2 of the comparative example has a cylindrical outer race with no flange portion. The separate component x1 as the ring blade is formed, at its outer circumferential surface, with a conical surface and, at its largest diameter portion, with a flange portion. The remaining configuration is the same as that of the present embodiment. In this case, the radial bearing x2 is used only as a component to reduce the frictional force against rotation.

The creasing device 100X of the comparative example uses the separate component x1 and the radial bearing x2 for the rotary blade 135X. This increases the number of components to be used, and requires the assembly of the separate component x1 and the radial bearing x2 to increase the cost. Thus, the rotary blade 135X and the creasing device 100X of the comparative example become complicated in configuration.

In contrast, in the creasing device 100 of this embodiment, the separate component x1 as a blade portion is not used, and the radial bearing itself acts as the rotary blade 135. Therefore, it becomes possible to decrease the number of components and eliminate the attachment work of the separate component x1 as a blade portion to the radial bearing, thereby reducing the cost. Thus, the rotary blade 135 and the creasing device 100 are simplified in configuration.

In the creasing device 100X of the comparative example, the rotary blade 135X is a combined component prepared by covering the outer circumferential side of the radial bearing x2 with the separate component x1 as a blade portion. In contrast, the rotary blade 135 of the creasing device 100 of this embodiment is configured by only the radial bearing as a single component. Therefore, the diameter of the flange portion 135*c* of the radial bearing itself becomes the diameter of the rotary blade 135.

Moreover, for the radial bearing, the flange portion 135*c* is a site that is small in projection in the radial direction. Therefore, the total diameter of the rotary blade 135 becomes approximately the same diameter as that of the outer race 135*b* of the radial bearing (that is, a diameter made by increasing a diameter d1 of the radial bearing x2 of FIG. 14B by the part of the flange portion 135*c*), thereby being minimized.

The creasing device 100 of this embodiment is made small, due to that the diameter of the rotary blade 135 has become smaller as compared with a diameter d2 of the rotary blade 135 of the creasing device 100X of the comparative example. In other words, the creasing device 100 of this embodiment can be made smaller by at least one size in the height direction Z (FIGS. 13 and 14A) and the width direction Y (FIG. 15) than the creasing device 100X of the comparative example.

Furthermore, in the creasing device 100 of this embodiment, the rotary blade 135 is composed of only the radial bearing by eliminating the separate component x1 as a blade portion like that of the creasing device 100X of the comparative example. Therefore, in the rotary blade 135, the precision of the radial bearing itself as a single body becomes the precision of the rotary blade 135 as a whole. Thus, the rotary blade 135 can improve the precision of processing the crease 310 on the paper 300. In addition, due to no accumulation of errors and plays by multiple components, the rotary blade 135 becomes less in error and play.

(2) In the creasing device 100, a support shaft 136 for supporting the rotary blade 135 may include a position setting portion 134 that positions a side surface of the inner race 135*a* of the rotary blade 135 in an axial direction such that the flange portion 135*c* matches with a position of the groove 124. Thus, the position setting portion 134 holds the rotary blade 135 in the axial direction in a condition that the side surface of the inner race 135*a* of the rotary blade 135 is locked in the axial direction. With this, the position setting portion 134 can precisely position the flange portion 135*c* relative to the groove 124 by its thickness in the axial direction. In other words, the flange portion 135*c* of the rotary blade 135 is positioned by the setting of the thickness in the axial direction of the position setting portion 134 such that the center of the blade thickness W3 aligns with the center in the groove width direction of the groove 124. The position setting portion 134 can precisely position the flange portion 135*c* relative to the groove 124, thereby obtaining the creasing device 100, which is free from the variation in production and which can form the clear and optimal crease 310 on the paper 300. For example, if the flange portion 135*c* becomes close to the groove 124 by the variation in production, it tends to shear the paper 300. In contrast, if the flange portion 135*c* becomes far from the groove 124, the shear force becomes weak to result in a weak creasing. The creasing device 100 of this embodiment can prevent such problems.

(3) According to the creasing device 100, in the rotary blade 135, the outer race 135*b* of the radial bearing may be spaced away from an upper surface 121 of the receiving member 120 to have a gap S of a dimension that is greater than a thickness of the paper 300. The outer race 135*b* of the radial bearing may be disposed at a position where the paper 300, which has been raised from the upper surface 121 of the receiving member 120, is brought into abutment therewith. In a condition that the paper 300 has been fed in the transport direction X, the outer race 135*b* of the radical bearing, which has been spaced away to have the gap S, suppresses raising of the paper 300 during the creasing. In this way, when the outer race 135*b* and the upper surface 121 of the receiving member 120 are disposed to be spaced away from each other with the gap S therebetween, it is possible to feed the paper 300 with no trouble and to suppress raising of the paper 300 during the creasing by pressing with the outer race 135*b*. Therefore, it is possible to prevent the creasing's weakening, which is caused by an excessive raising of the paper 300 during the creasing from the upper surface 121 of the receiving member 120, such that the clear and optimal crease 310 can always and stably be formed on the paper 300.

(4) In each case of the above (1) to (3), according to the creasing device 100, the receiving member 120 may be attached to a longitudinal plate 111 having an elongated hole 112 that allows the paper 300 to pass therethrough. The rotary blade 135 may be attached to a surface of the longitudinal plate 111 that is on the same side thereof as the receiving member is. The rotary blade 135 may be attached via a guide portion (linear guide formed of a guide rail 114 and a guided member 131) that guides the rotary blade 135 to move along the groove 124. The rotary blade 135 may be attached via the guide portion by using the support shaft 136 to a holding plate 133 that is installed to be parallel with the longitudinal plate. The linear guide and the radial bearing, which becomes the rotary blade 135, are commercially available products with guaranteed precision. Since the longitudinal plate 111 and the holding plate 133 are almost flat plates, it is easy to achieve the machining precision, and since they are directly attached to each other via the linear guide, it is easy to achieve the attachment precision. Therefore, it is possible to make the creasing device 100 into a device with a simple structure and a high precision in the height direction Z and the transport direction X. The support shaft 136 makes it possible to easily position the rotary blade 135 in the height direction Z and the transport direction X. In this embodiment, the position setting portion 134 positions the rotary blade 135 in the height direction Z and the transport direction X by providing the support shaft 136 with the position setting portion 134.

A printer 200 including the above creasing device 100 can obtain advantageous effects similar to those of the creasing device 100.

Another Disposition Example of Creasing Device in Printer

Figure 16:
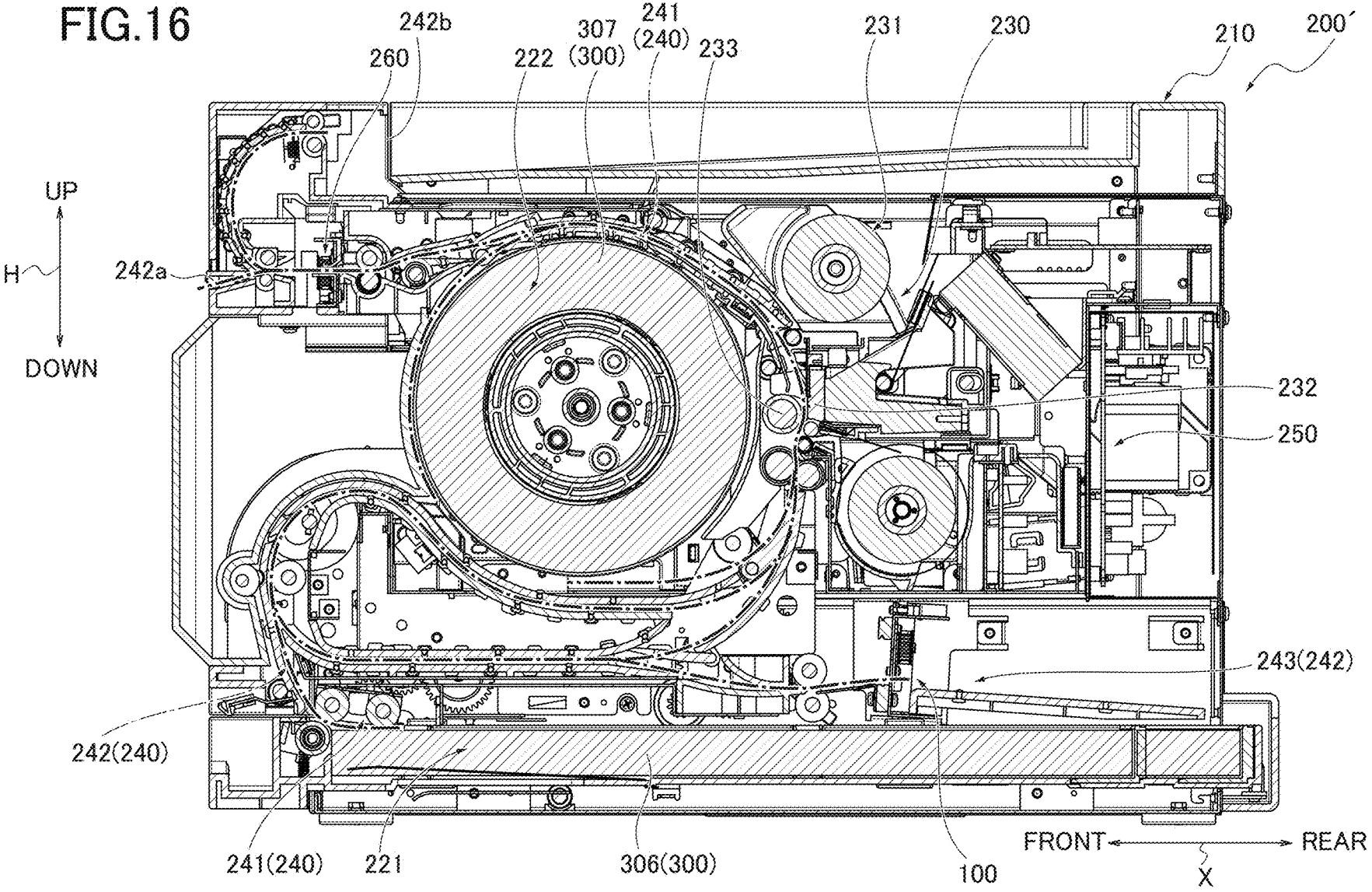
FIG. 16 is a view showing one example of arrangement of the paper creasing device in a photo printer.

FIG. 16 is a vertical cross-sectional view showing another photo printer 200' (hereinafter referred to as printer 200') including the creasing device 100, showing a disposition example of the creasing device 100 in the printer. The printer 200' is another embodiment of the printer according to the present application.

The printer 200 shown in FIG. 1 includes the creasing device 100, which is disposed at a position close to the cutter 260 provided in the vicinity of an outlet of the paper 300 in the printer 200, that is, at an upper front side of the printer 200.

In contrast, the printer 200' shown in FIG. 16 includes the creasing device 100 to be disposed below around a center portion in the front-rear directions (see the transport direction X in the drawing) of the printer 200'. The center portion is at a position at the center in the front-rear directions of the printer 200', and around the center portion refers to the center portion and its surrounding. In the drawing, the creasing device 100 is disposed at a position that is displaced slightly rearward from the center portion. Here, the printer 200' is also a printer of a dye-sublimation thermal-transfer type, similar to the printer 200. The printer 200' can select either sheet paper 306, which is cut paper, or roll paper 307, which is formed into a roll by rolling a long strip of paper.

The printer 200' includes an outer case 210, a sheet paper storage section 221, a roll paper storage section 222, a printing section 230, a cutter 260, the creasing device 100, a conveying portion 241 and conveying paths 242 for composing conveyors 240, and a controller 250. The printing section 230, the cutter 260, and the controller 250 in the printer 200' are disposed at positions similar to those of the printing section 230, the cutter 260, and the controller 250 in the printer 200, respectively.

The sheet paper storage section 221 is a paper storage section that stores many sheets of the sheet paper 306 by stacking them in the thickness direction, and is disposed at a lower end portion of the printer 200', similar to the paper storage section 220 in the printer 200 shown in FIG. 1. The roll paper storage section 222 is a paper storage section (space) that stores the roll paper 307, and is disposed at a position that is in front of the printing section 230 in the printer 200' and that is above the sheet paper storage section 221.

The printer 200' includes a front outlet 242*a* for discharging the sheet paper 306 or roll paper 307 after printing in the printing section 230, to the outside toward the front, and an upper outlet 242*b* for discharging that to a discharge tray toward the back. The front outlet 242*a* is provided at an upper part on a front side surface of the printer 200', and the upper outlet 242*b* is provided to be open rearward at an upper part or upper surface of the printer 200'. The discharge tray is provided at an upper part or upper surface of the printer 200'. The printer 200' discharges the sheet paper 306 or roll paper 307 to the outside of the front of the printer 200' or to the discharge tray of an upper part thereof by the controller 250 selectively switching between the front outlet 242*a* and the upper outlet 242*b*.

As shown in FIG. 16, the creasing device 100 is disposed, rearward in the front-rear directions than the roll paper storage section 222, at around a center portion in the front-rear directions (transport direction X) of the printer 200'. In the height directions (vertical directions) H of the printer 200', the creasing device 100 is disposed at a position that is above the sheet paper storage section 221 provided at a lower end portion of the printer 200' and that is below the printing section 230 provided with the ink ribbon 231 and the thermal head 232.

The position, where the creasing device 100 has been disposed, is a region that tends to become a hard-to-use space in the printer 200'. Therefore, it is possible to put the creasing device 100 into the above region without enlarging the printer 200' in the front-rear directions, thereby effectively using space in the printer 200'.

The creasing device 100 is disposed at around the center portion in the front-rear directions of the printer 200'. The creasing device 100 may be disposed, in the middle of a creasing path 243 extending to the rear along the front-rear direction, below the roll paper storage section 222, of the conveying path 242. With this, the printer 200' can form the crease 310 at around either end in the transport direction X of the sheet paper 306, which passes through the creasing path 243, by the creasing device 100 disposed at around the center portion in the front-rear direction. Besides, the printer 200' can form the crease 310 at the center portion, too, in the transport direction X of the sheet paper 306, which passes through the creasing path 243, by the creasing device 100 disposed at around the center portion in the front-back direction.

It is possible to improve openability of each sheet paper 306, for example, when a photo book has been made by binding multiple sheets of the printed sheet paper 306, by the creasing device 100 forming the crease 310 at around an end portion in the transport direction X of the sheet paper 306. Furthermore, for example, it is possible to form a fold at the center of a greeting card made by a single sheet of the sheet paper 306 by the creasing device 100 forming the crease 310 at around the center portion in the transport direction X of the sheet paper 306.

As above, the embodiments have been described, but the present application is not limited to the embodiments. For example, in the embodiments, the creasing device 100 is incorporated as a module into the printer 200, and the moving mechanism 180 operates by the control of the controller 250 of the printer 200.

However, the creasing device 100 may be configured as a single device that is independent from the printer 200, by including an outer case, which covers the entirety of the creasing device 100, and a control part, which relates to the operation of the moving mechanism 180, of the controller 250.

The invention claimed is:

1. A paper creasing device, comprising:

a receiving member provided with a groove that extends in a fixed direction;

a rotary blade that is configured to be movable along the groove; and a moving mechanism for moving the rotary blade along the groove, wherein the rotary blade includes a radial bearing that is formed of a combination of an inner race and an outer race, the radial bearing including a flange portion that is monolithically formed with the outer race, wherein the radial bearing is configured to move by the moving mechanism, while the radial bearing sandwiches a paper between the flange portion and the groove and keeps a condition in which the flange portion is inserted in the groove, wherein the receiving member is attached to a longitudinal plate having an elongated hole that allows the paper to pass therethrough, and wherein the rotary blade is attached to a surface of the longitudinal plate that is on a same side thereof as the receiving member is, the rotary blade being attached by using a support shaft to a holding plate that is installed, to be parallel with the longitudinal plate, via a guide portion that guides the rotary blade to move along the groove.

2. The paper creasing device according to claim 1, wherein the support shaft supports the rotary blade and comprises a position setting portion that positions a side surface of the inner race of the rotary blade in an axial direction such that the flange portion matches with a position of the groove.

3. The paper creasing device according to claim 1, wherein, in the rotary blade, the outer race of the radial bearing is spaced away from an upper surface of the receiving member to have a gap of a dimension that is greater than a thickness of the paper, the outer race of the radial bearing being disposed at a position where the paper, which has been raised from the upper surface of the receiving member, is brought into abutment therewith.

4. A printer comprising the paper creasing device according to claim 1.

* * * * *